US005403103A

United States Patent [19]

Ayres

[11] Patent Number: 5,403,103

[45] Date of Patent: Apr. 4, 1995

[54] DISPOSABLE RIBBON CASSETTE WITHIN A RELOADABLE CARTRIDGE

[76] Inventor: David W. Ayres, 330 N. Screenland Dr. #304, Burbank, Calif. 91505

[21] Appl. No.: 277,790

[22] Filed: Jul. 20, 1994

Related U.S. Application Data

[63] Continuation of Ser. No. 44,306, Apr. 6, 1993, abandoned.

[51] Int. Cl.[6] ..... B41J 35/28

[52] U.S. Cl. ..... 400/208; 400/196.1; 400/250

[58] Field of Search ..... 400/194, 195, 196, 196.1, 400/207, 208, 250, 693.1, 234

[56] References Cited

U.S. PATENT DOCUMENTS

| | | | |
|---|---|---|---|
| 2,825,450 | 3/1958 | Lambert | 206/52 |
| 3,151,723 | 10/1964 | Wendt | 197/151 |
| 3,151,724 | 10/1964 | Ross | 197/151 |
| 3,260,344 | 7/1966 | Doyle | 197/151 |
| 3,833,108 | 9/1974 | Von Daeniken | 197/151 |
| 3,924,727 | 12/1975 | Morelli | 197/151 |
| 3,976,183 | 8/1976 | Fleischmann et al. | 400/228 |
| 3,977,511 | 8/1976 | Hengelhaupt | 197/151 |
| 4,113,750 | 9/1978 | Isobe | 206/388 |
| 4,213,715 | 7/1980 | Haftmann | 400/196.1 |
| 4,240,757 | 12/1980 | Hanna | 400/196.1 |
| 4,325,646 | 4/1982 | Sasaki | 400/196.1 |
| 4,367,963 | 1/1983 | Daughters | 400/208 |
| 4,484,825 | 11/1984 | Wilczewski et al. | 400/196.1 |
| 4,616,942 | 10/1986 | Nagasawa et al. | 400/196.1 |
| 4,783,184 | 11/1988 | Santillo | 400/196.1 |
| 4,854,755 | 8/1989 | Lange et al. | 400/208.1 |
| 4,861,177 | 8/1989 | Heins et al. | 400/208 |
| 4,900,170 | 2/1990 | Beck | 400/196 |
| 4,913,572 | 4/1990 | Behrens et al. | 400/207 |
| 4,944,619 | 7/1990 | Suzuki | 400/224.2 |
| 4,955,737 | 9/1990 | Haftmann et al. | 400/208 |
| 4,964,743 | 10/1990 | Haftmann | 400/208.1 |
| 4,990,006 | 2/1991 | Haftmann | 400/208 |
| 4,990,007 | 2/1991 | Schmidt et al. | 400/208 |
| 4,990,008 | 2/1991 | Hwang | 400/208 |
| 4,998,833 | 3/1991 | Chiman | 400/208 |
| 5,044,795 | 9/1991 | Burgin | 400/208 |
| 5,127,750 | 7/1992 | Burgin | 400/208 |
| 5,160,206 | 11/1992 | Haftmann et al. | 400/208 |
| 5,215,012 | 6/1993 | Kanno et al. | 400/196.1 |

*Primary Examiner*—Ren Yan

[57] ABSTRACT

A disposable ribbon cassette is releasably received by a reloadable cartridge which is removable from a printing device. The cassette contains the ribbon and guide paths therefore. The ribbon drive is from the printing device directly or via cartridge gears. For endless loop ribbon machines, the cassette includes a storage chamber into which the ribbon is loop piled, but for typewriter printing devices the cassette storage chamber includes a supply spool and a take-up spool. The cassette includes an exit guide path extending outwardly of the storage chamber with the ribbon coming from a storage chamber exit opening. An entry guide path in spaced apart relation to the exit guide path receives the used ribbon from the printing device and directs it to an entry opening in the storage chamber. These guide paths serve for automatic threading of the ribbon to the printing device. For devices using endless loop ribbon and some spool types, the drive is openable to receive the ribbon. Part of the drive may be spring biased to facilitate opening and also tension the ribbon. Otherwise tensioning is obtained directly against the ribbon or through structure associated with the drive, or both.

9 Claims, 23 Drawing Sheets

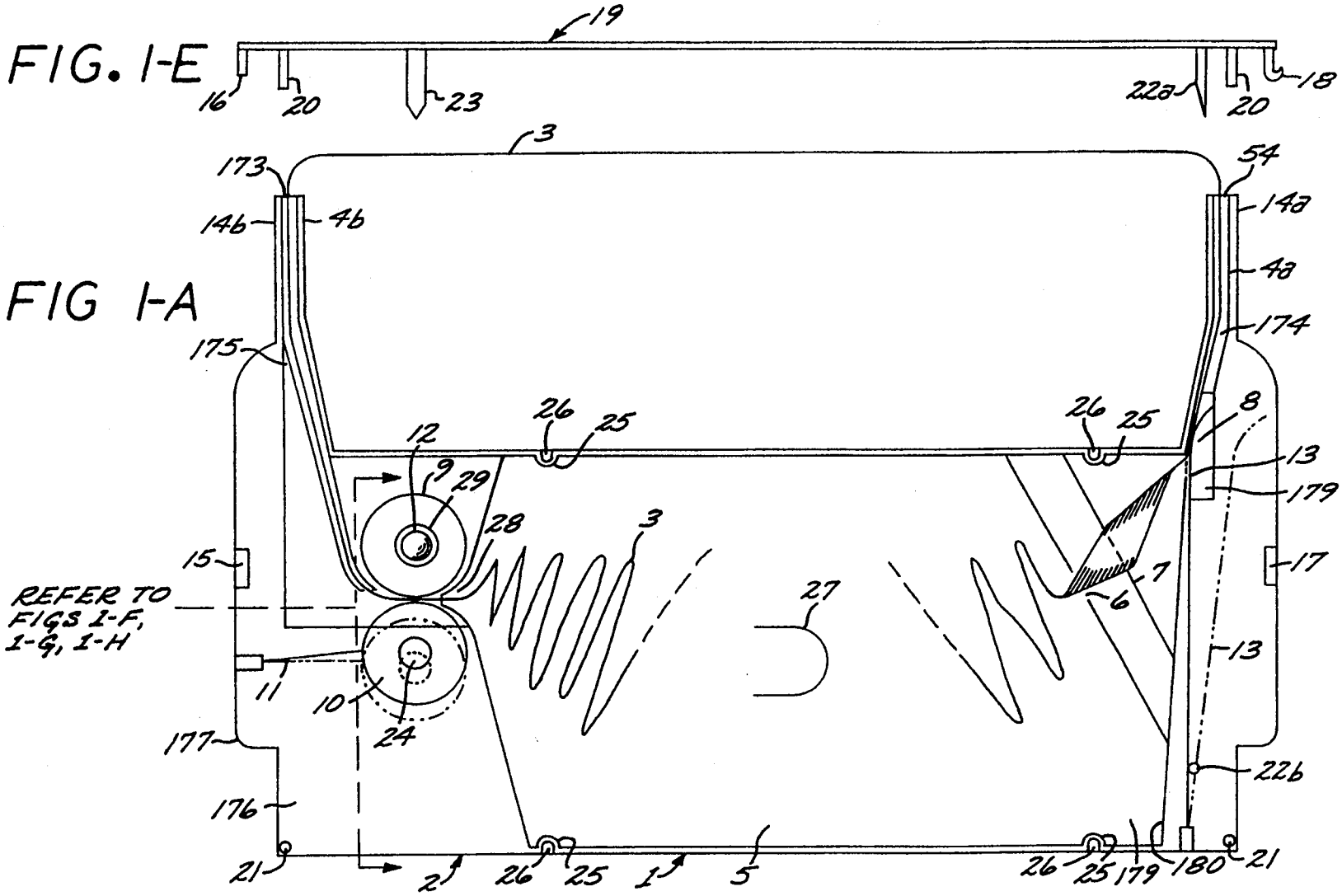
FIG. I-E
FIG I-A

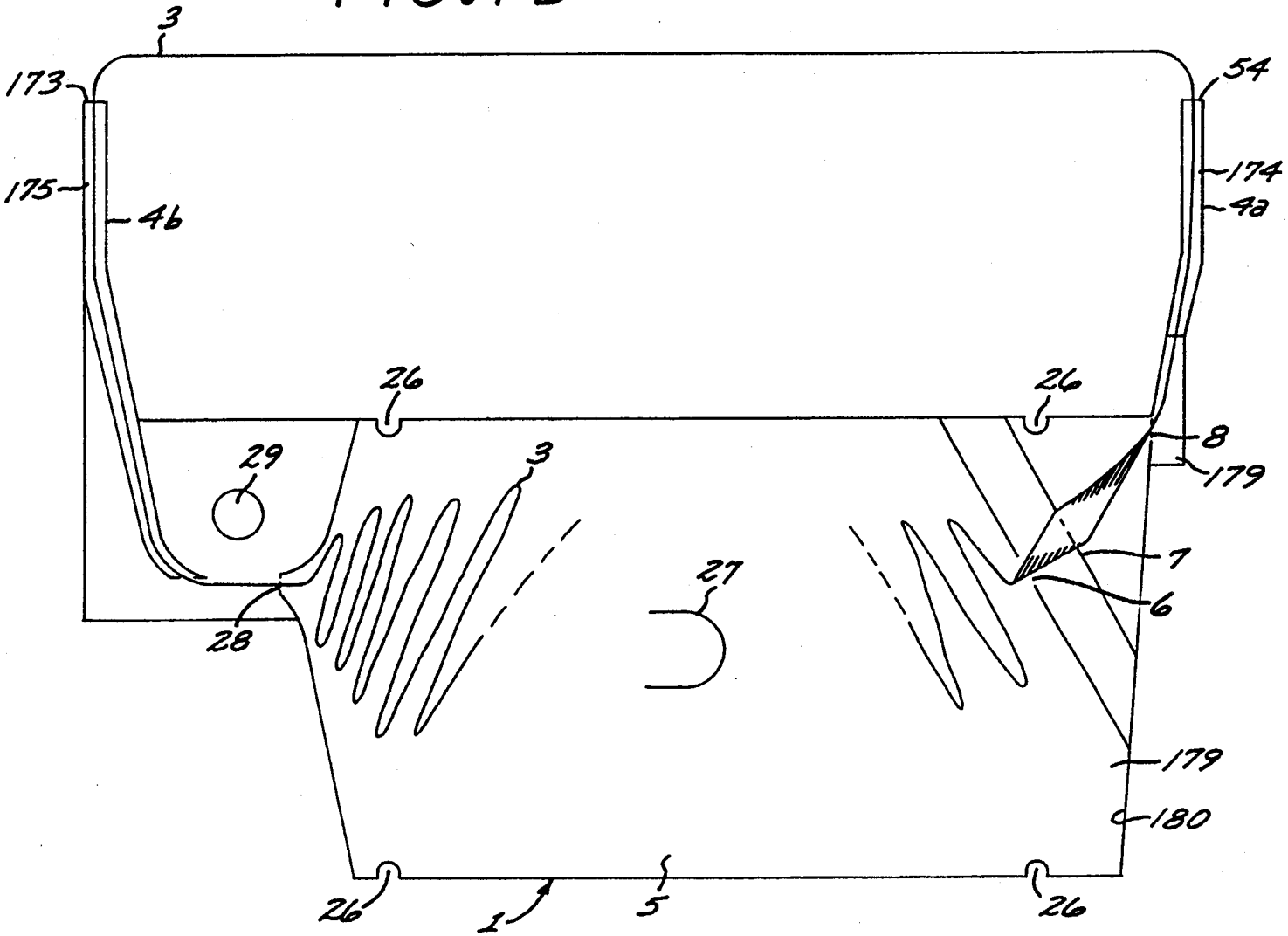
FIG. 1-B

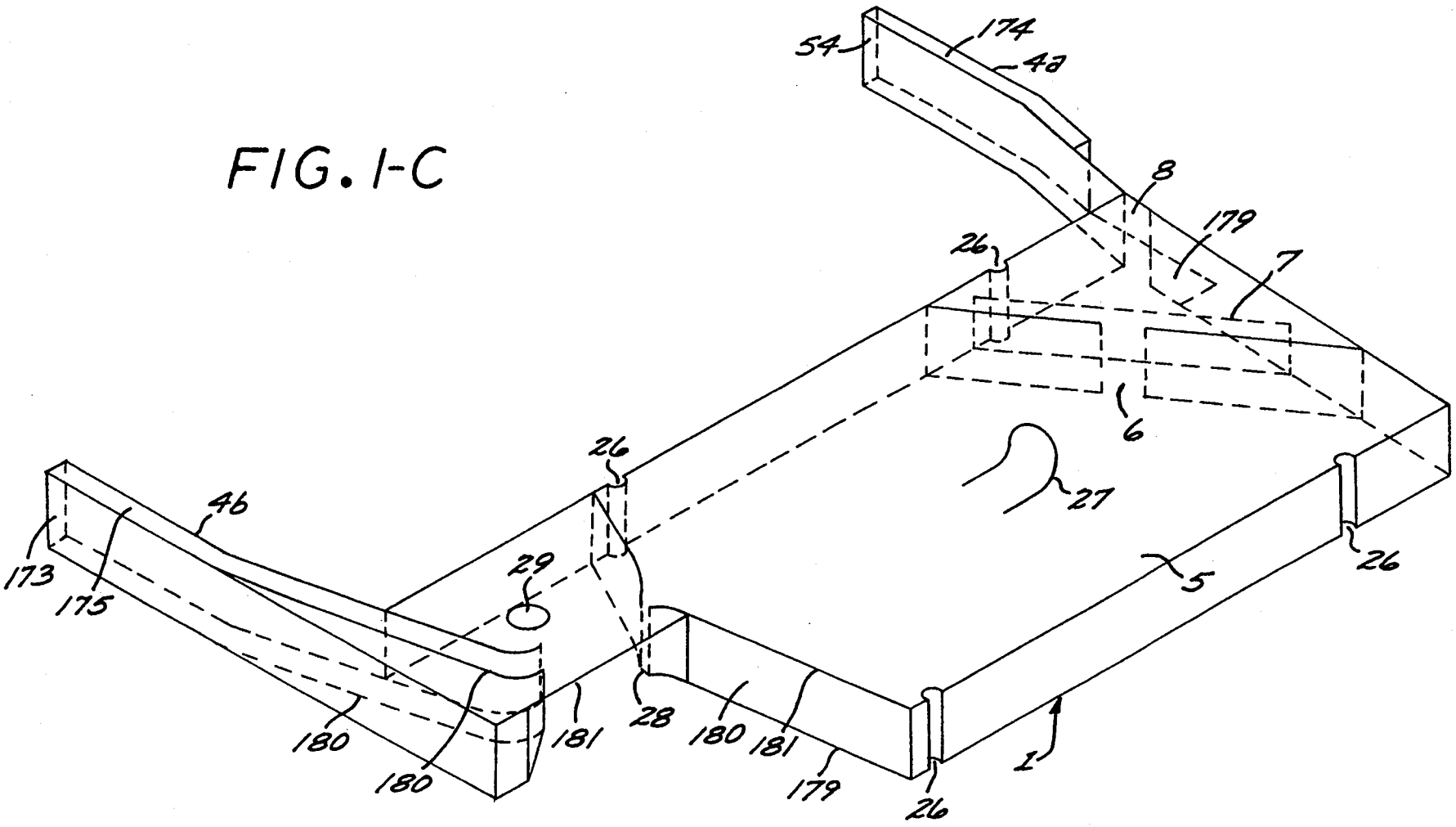
FIG. 1-C

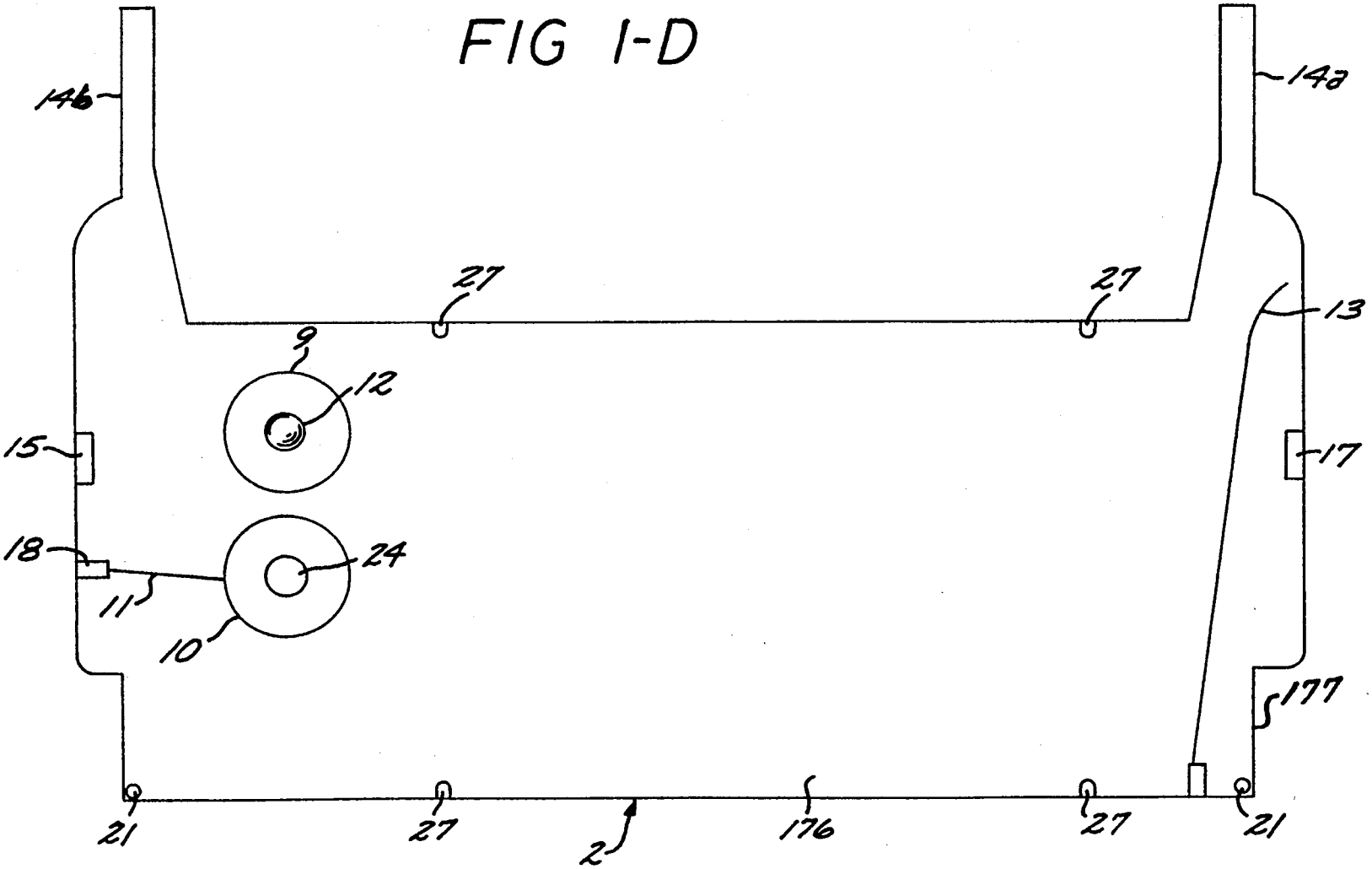
FIG 1-D

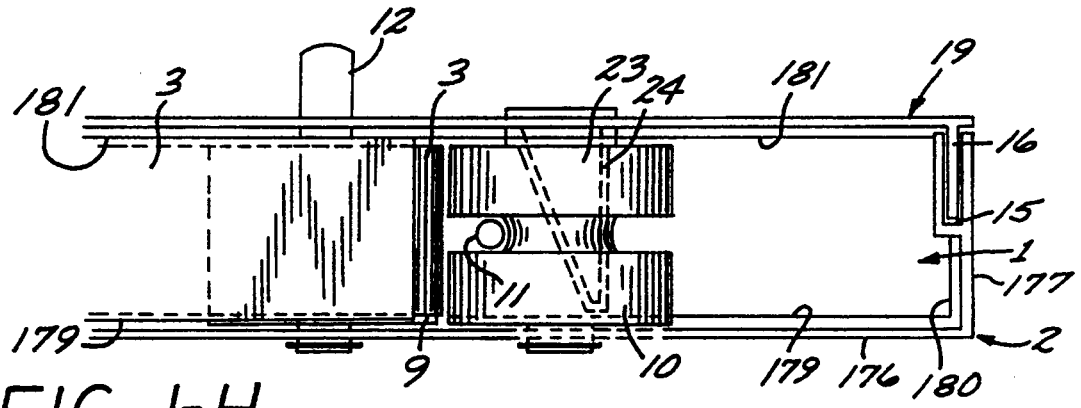
FIG. 1-H
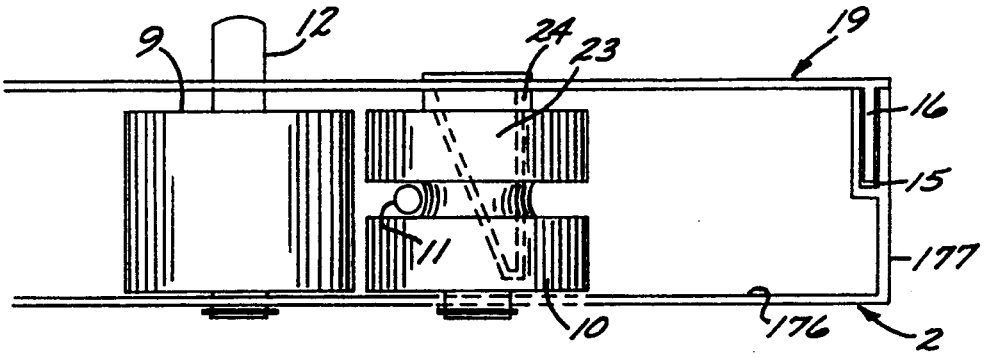
FIG. 1-G
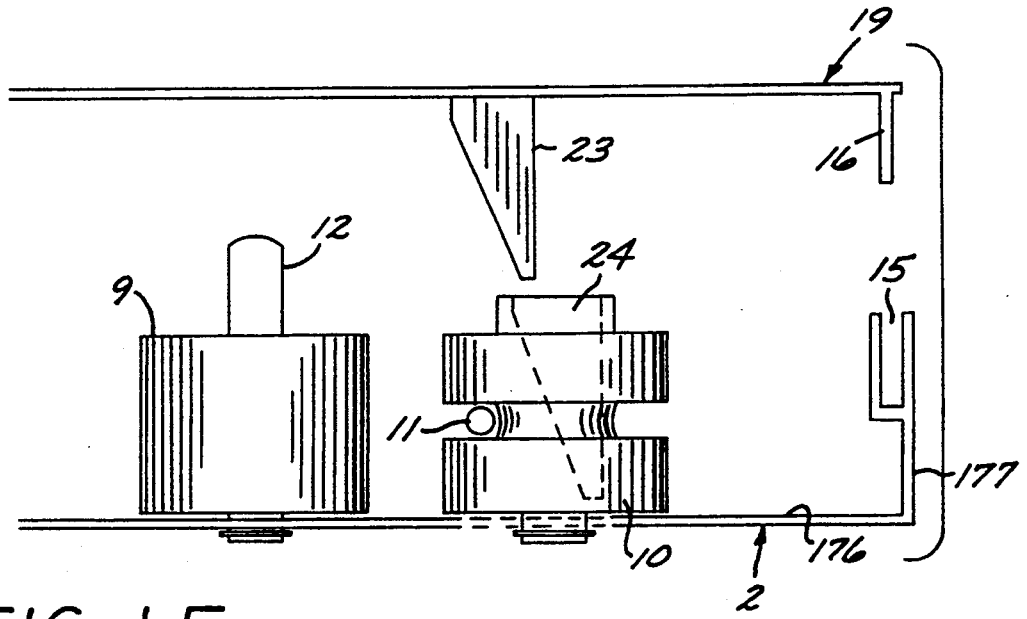
FIG. 1-F

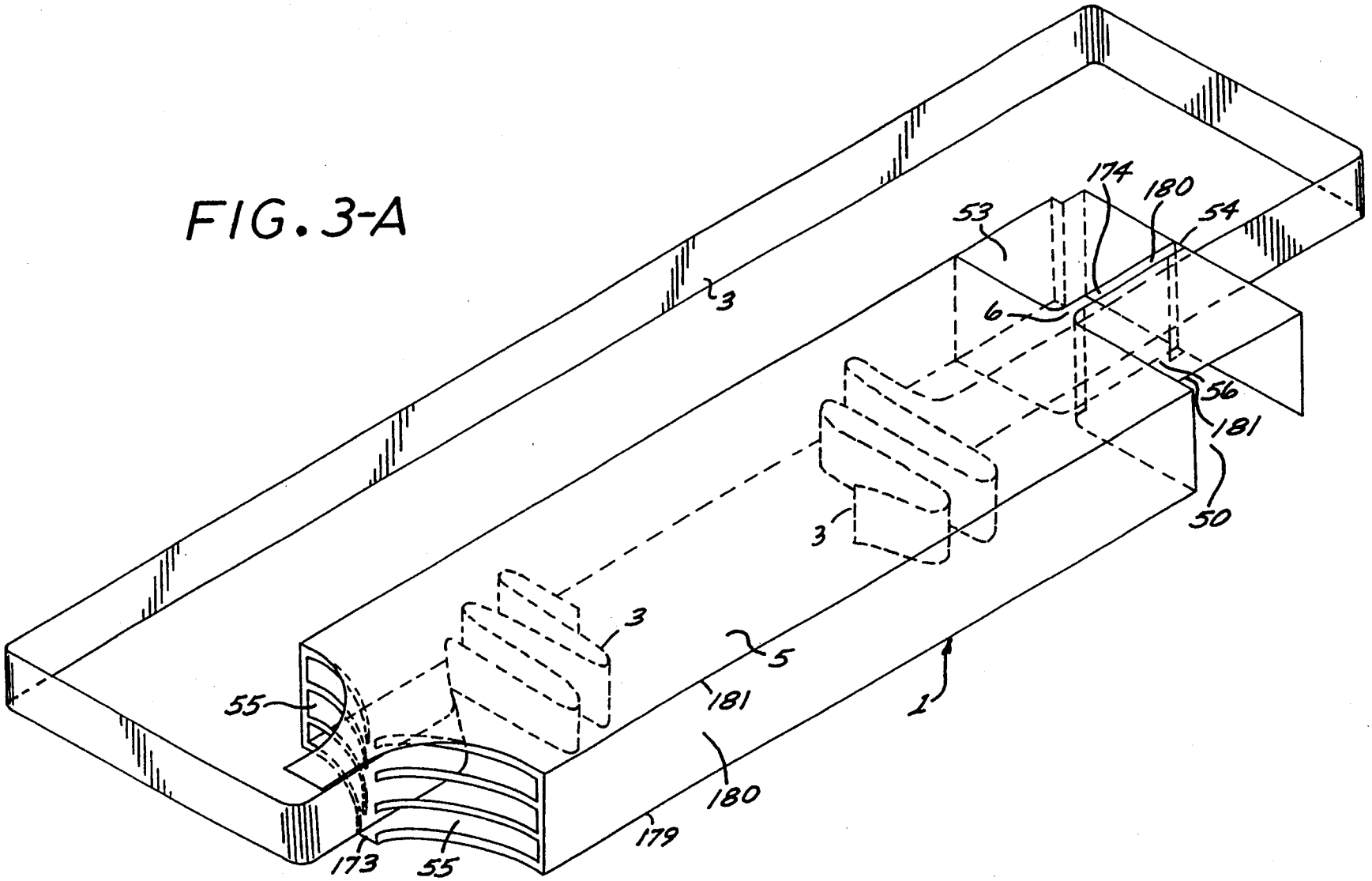
FIG. 3-A

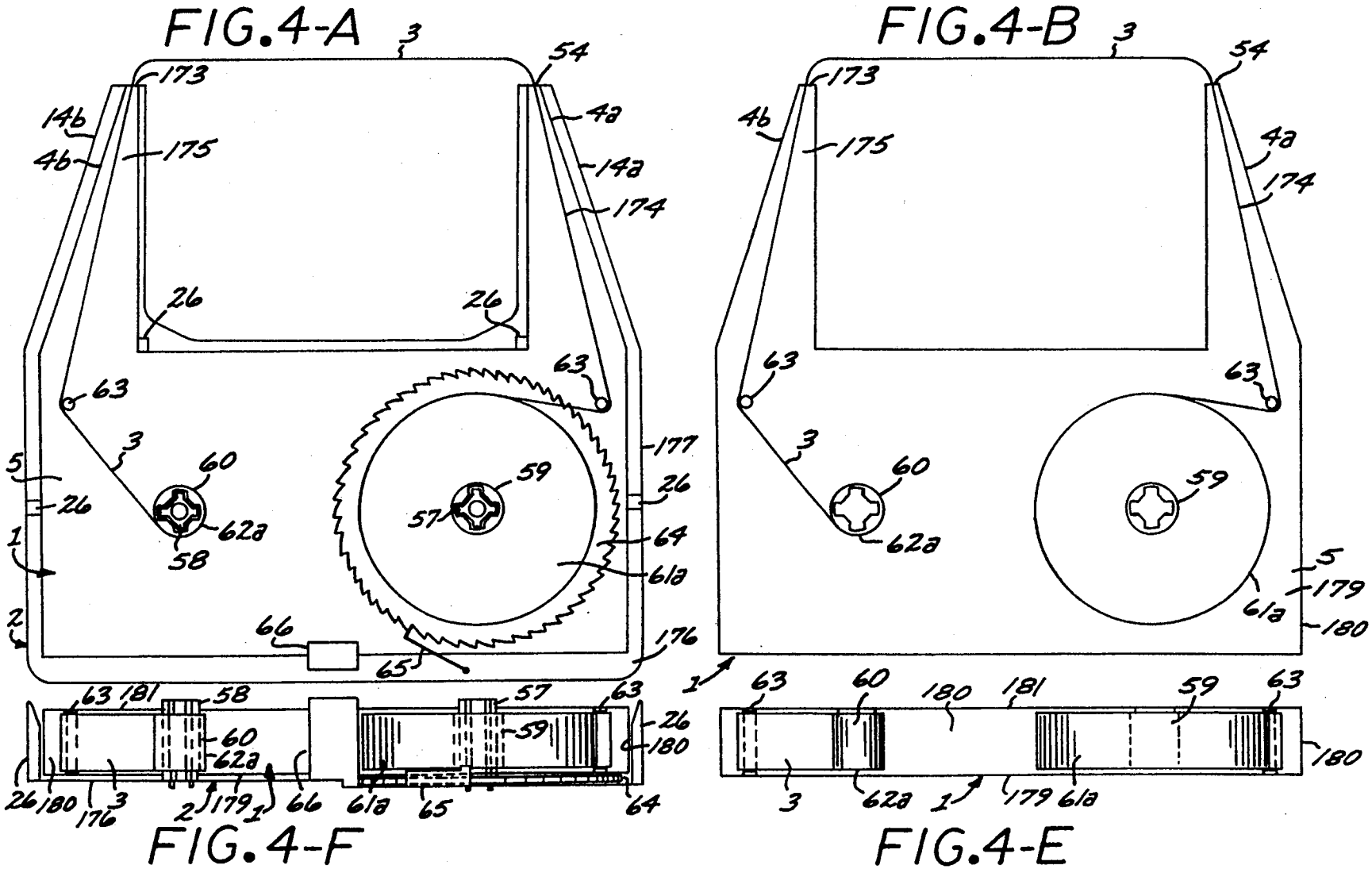
FIG.4-B
FIG.4-E
FIG.4-A
FIG.4-F

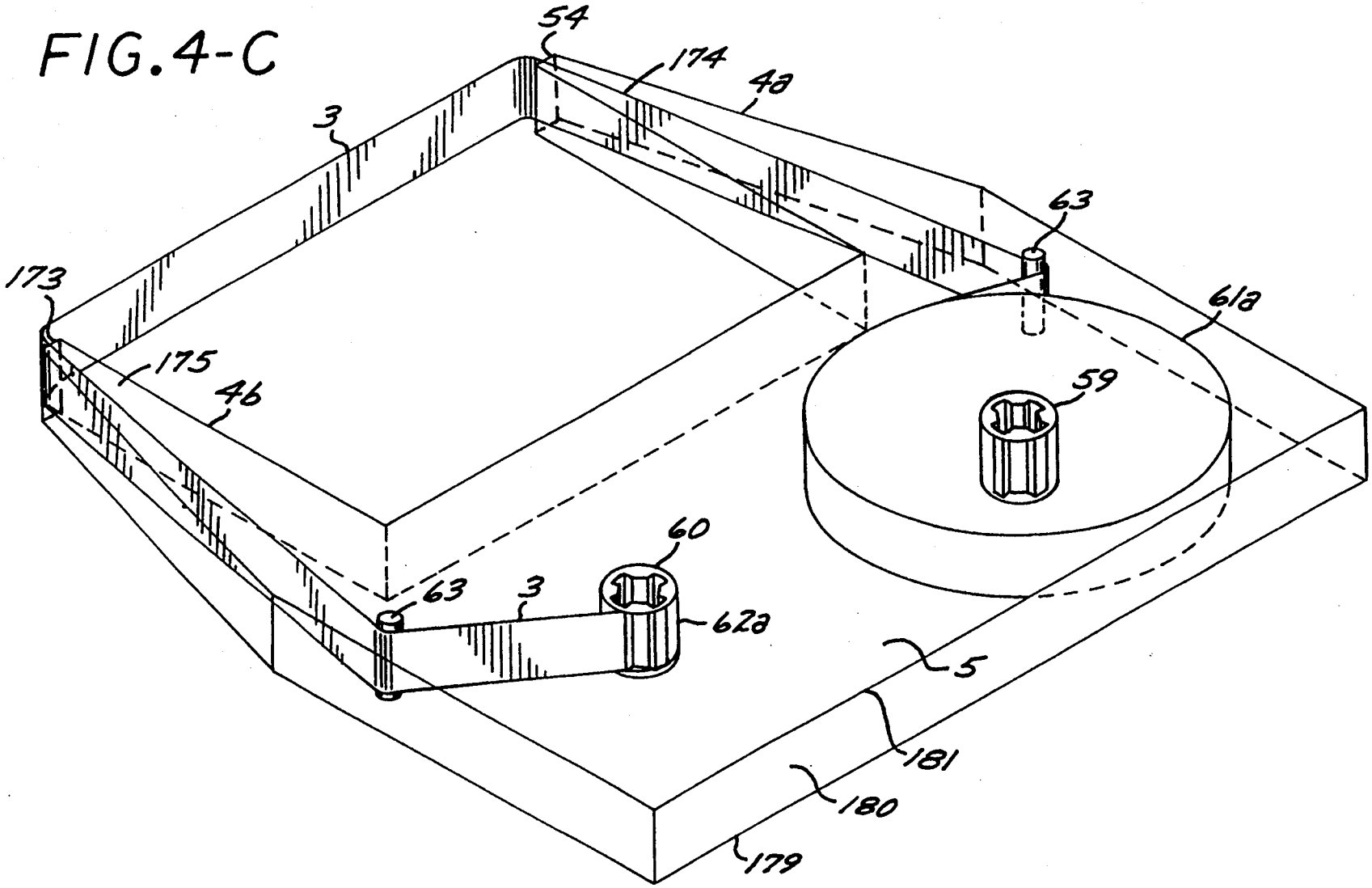
FIG. 4-C

FIG.4-D
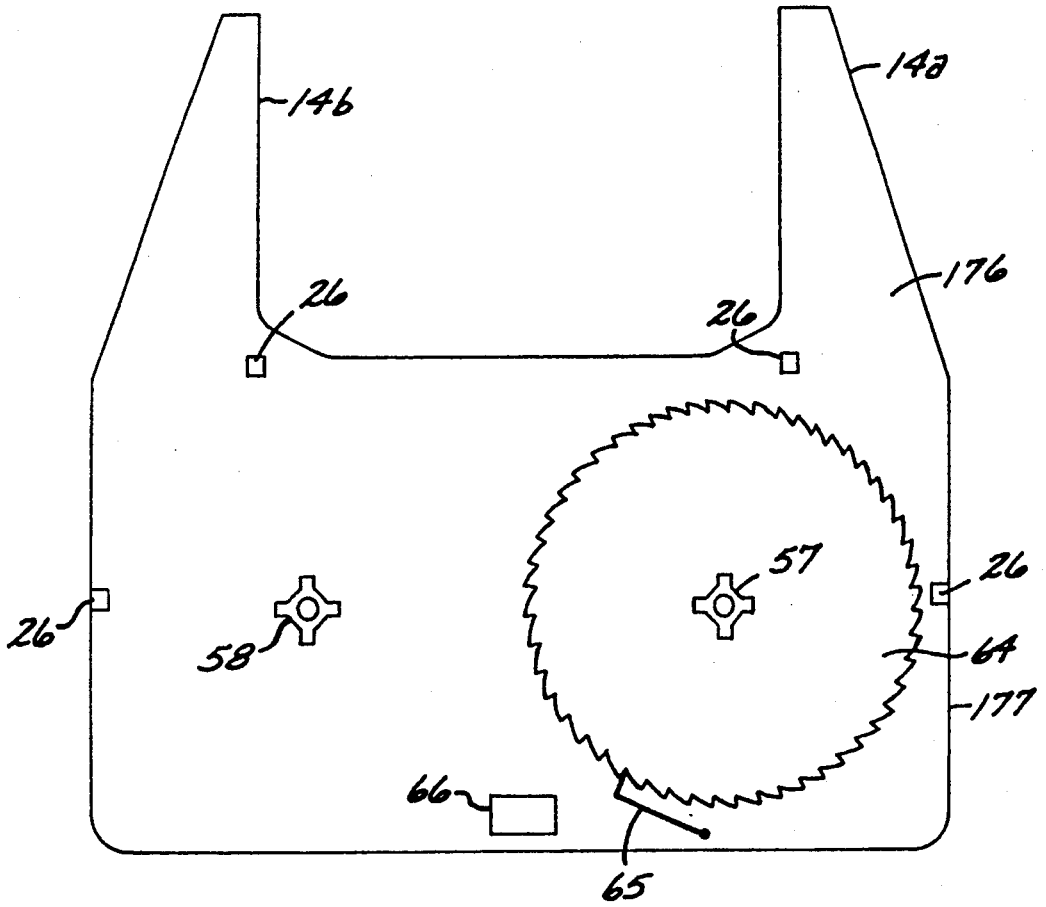
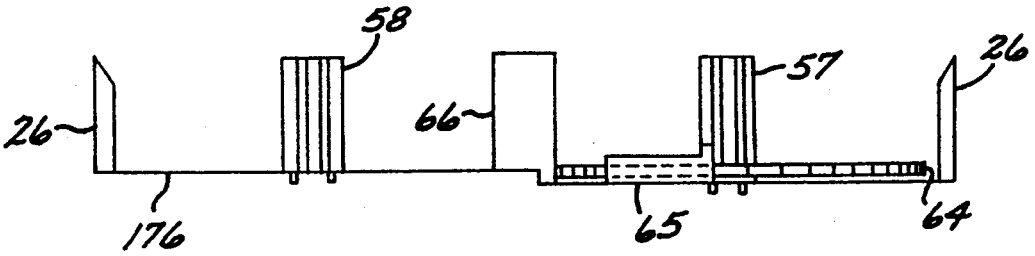
FIG.4-G

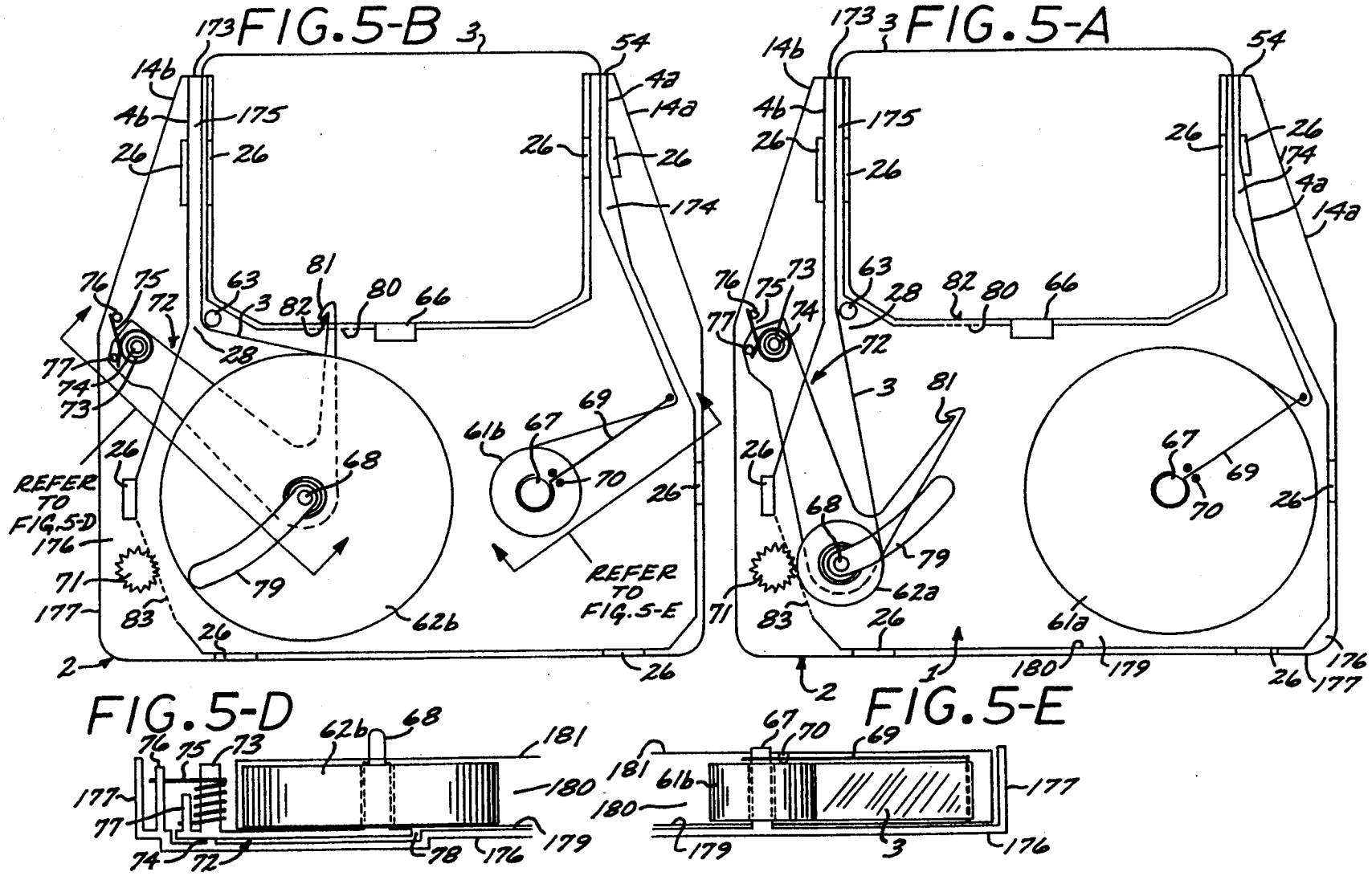
FIG. 5-A
FIG. 5-B
FIG. 5-D
FIG. 5-E
REFER TO FIG. 5-E
REFER TO FIG. 5-D

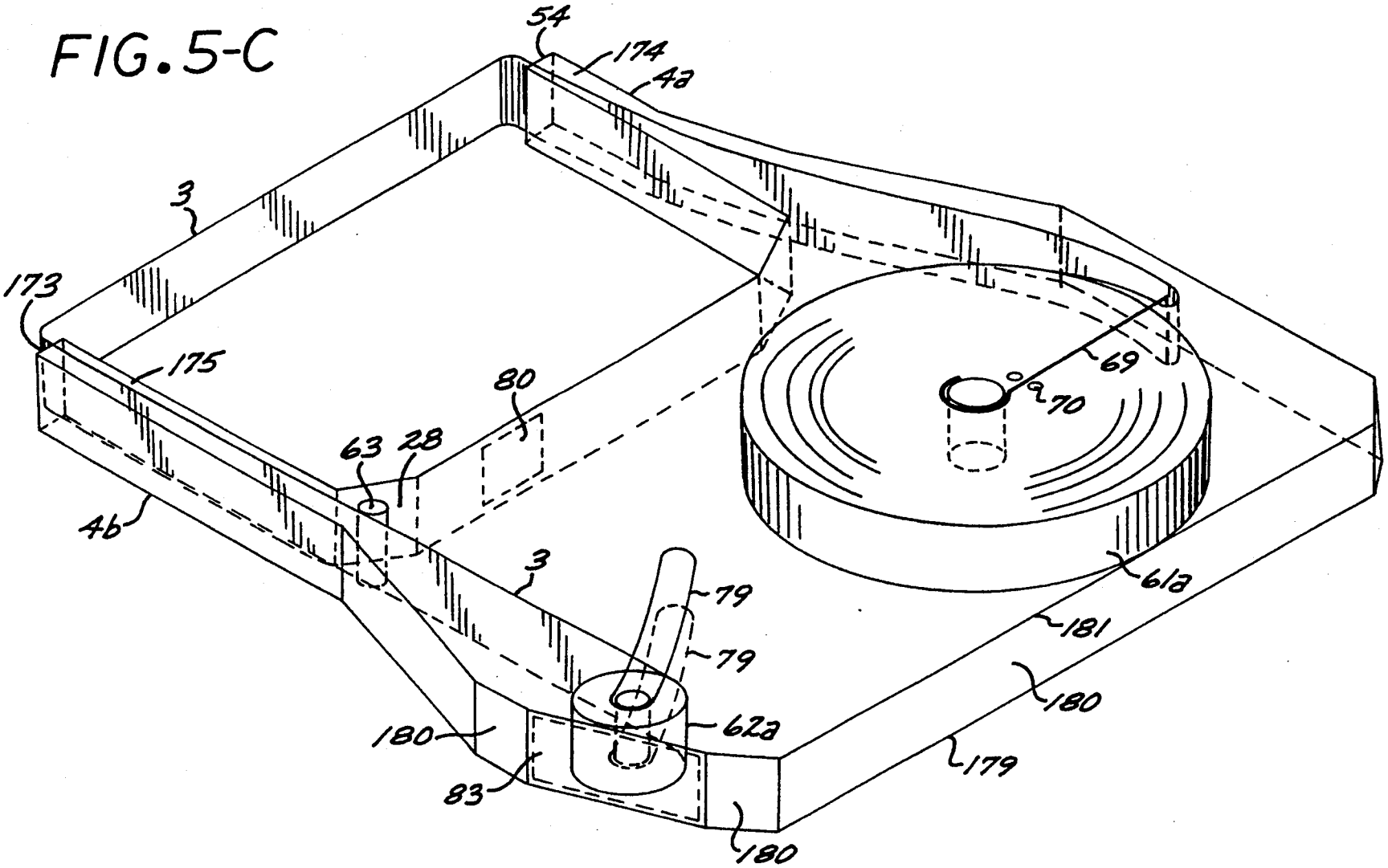
FIG. 5-C

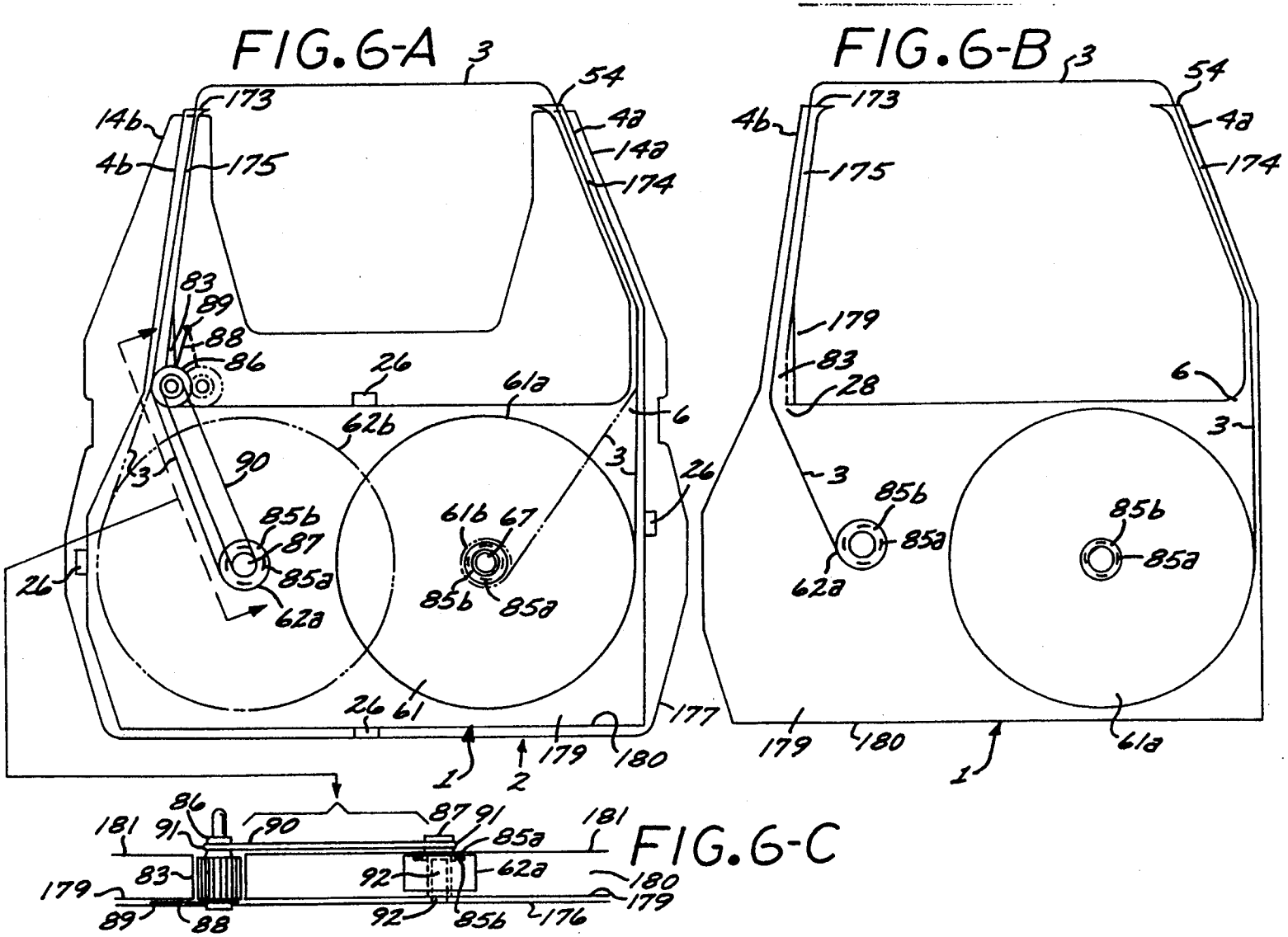
FIG. 6-A
FIG. 6-B
FIG. 6-C

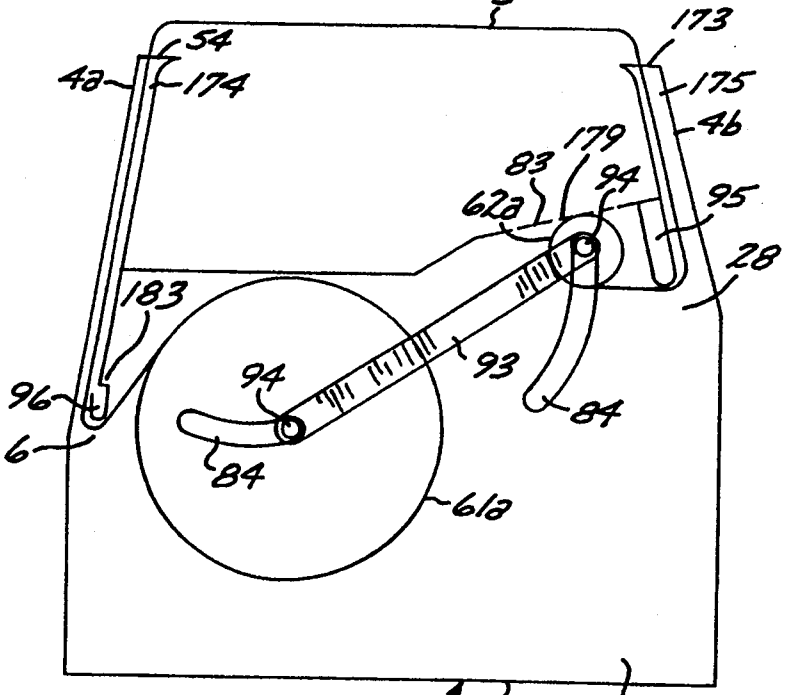
FIG. 7-B
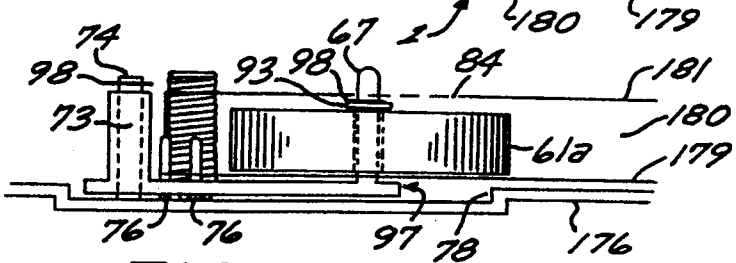
FIG. 7-F
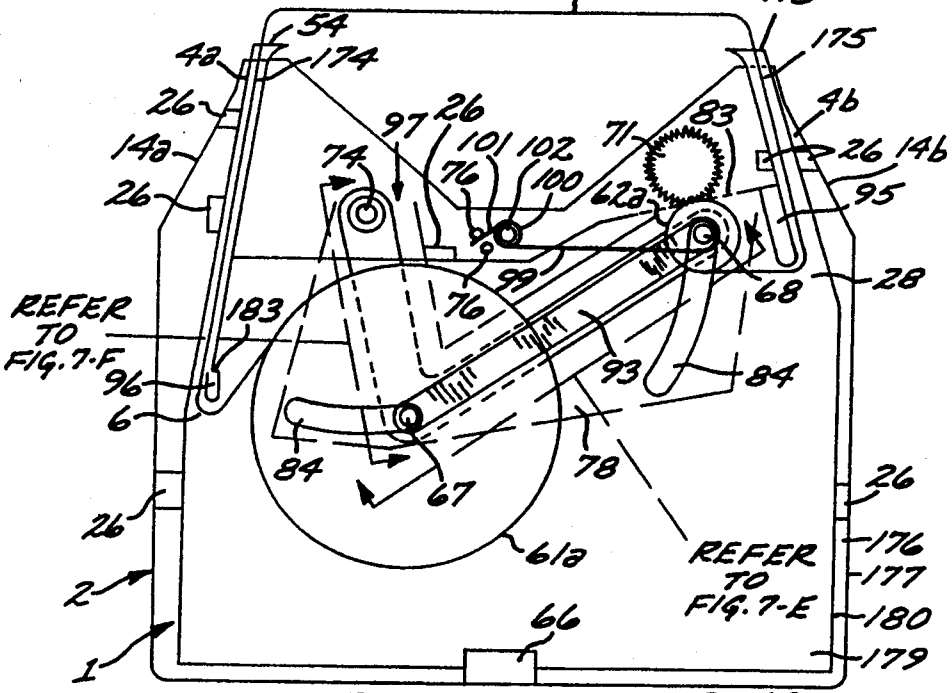
FIG. 7-A
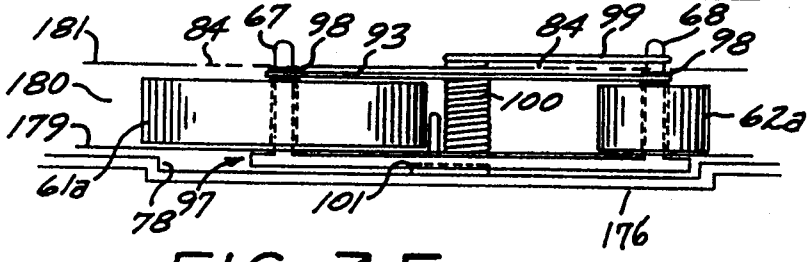
FIG. 7-E

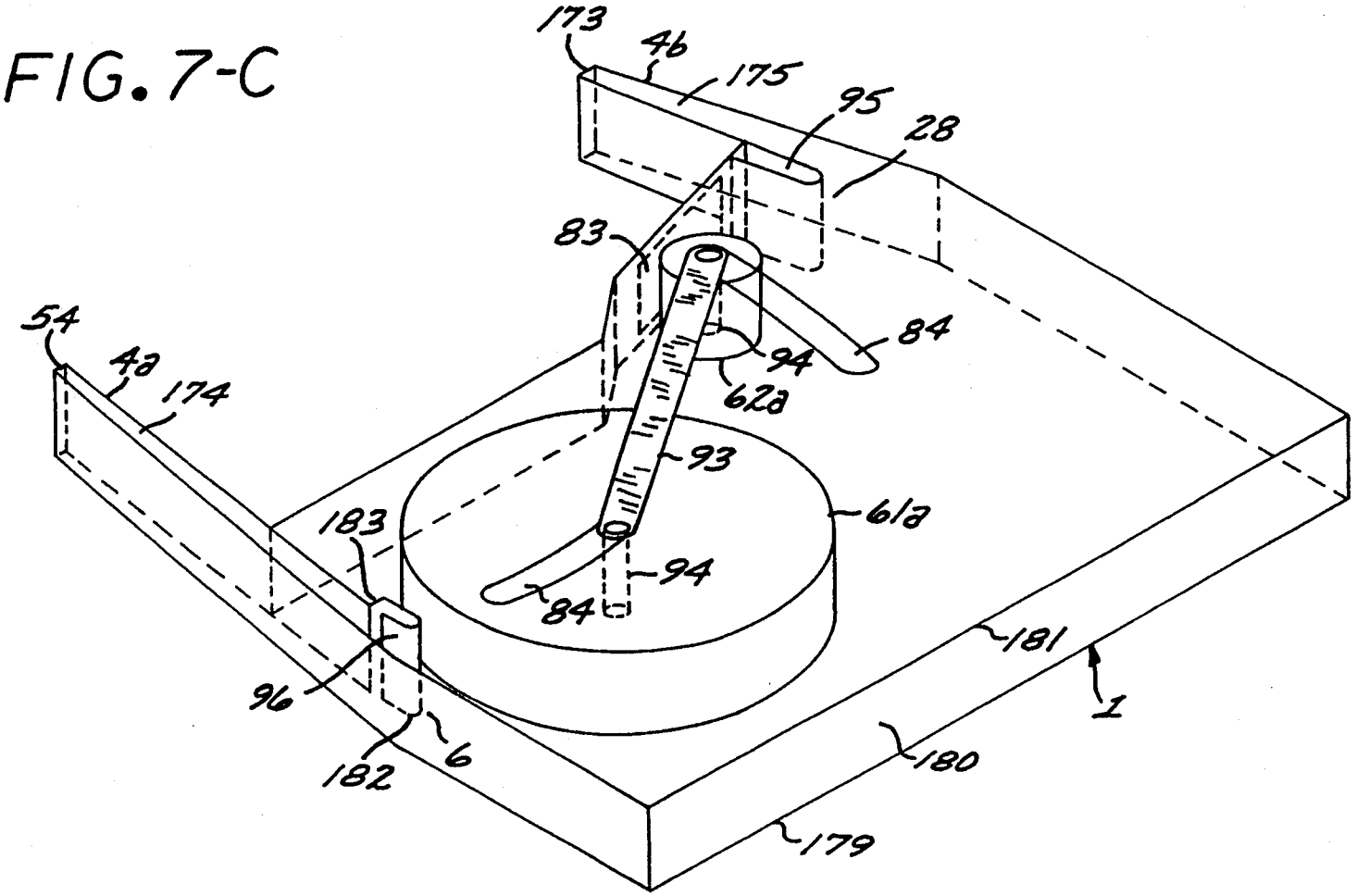
FIG. 7-C

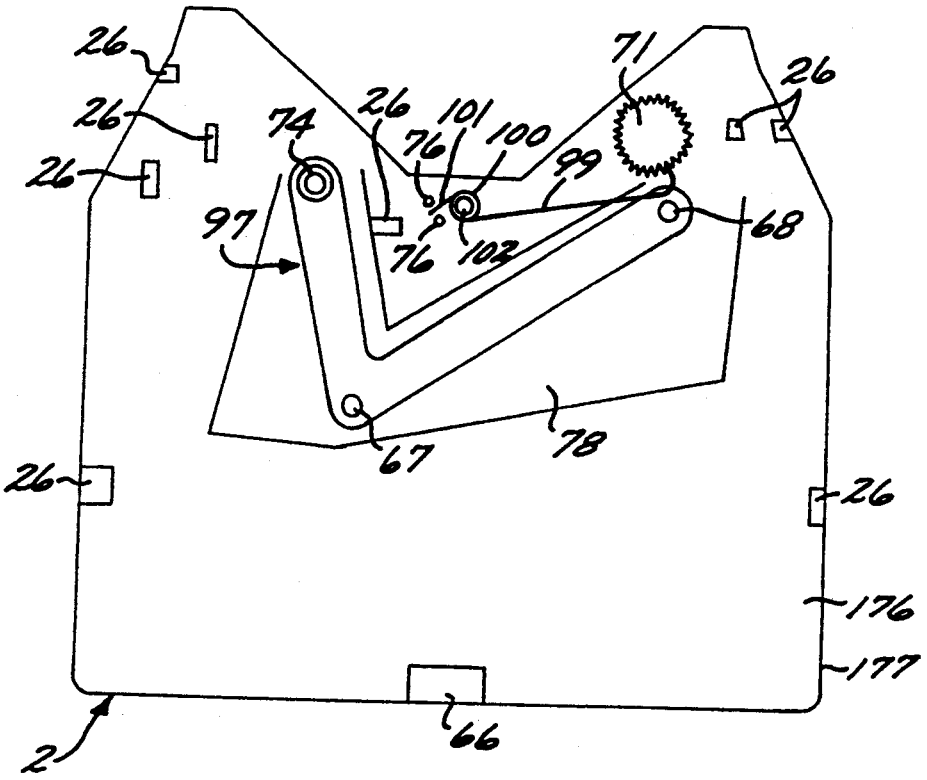
FIG. 7-D

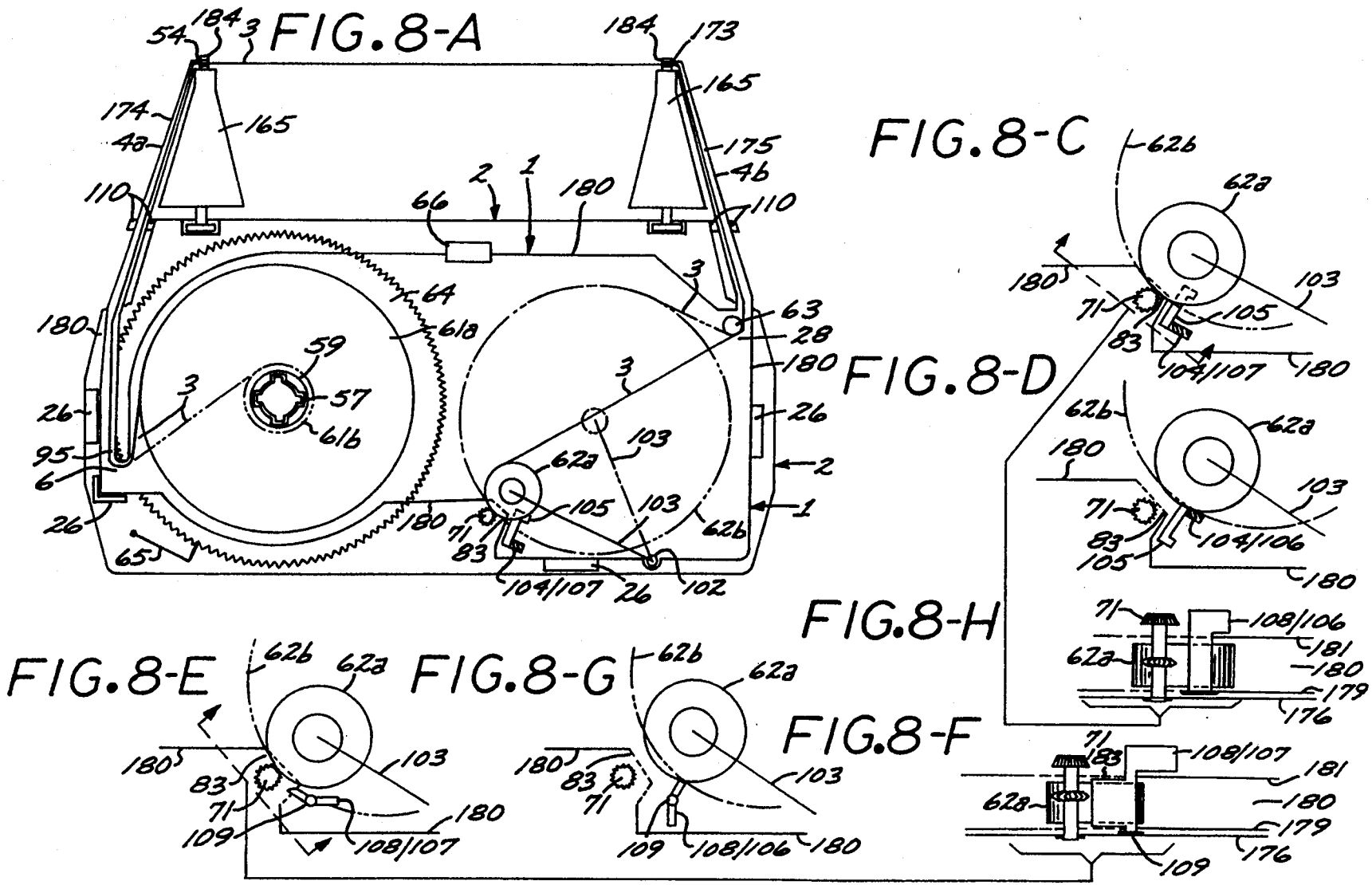
FIG. 8-A
FIG. 8-C
FIG. 8-D
FIG. 8-E
FIG. 8-F
FIG. 8-G
FIG. 8-H

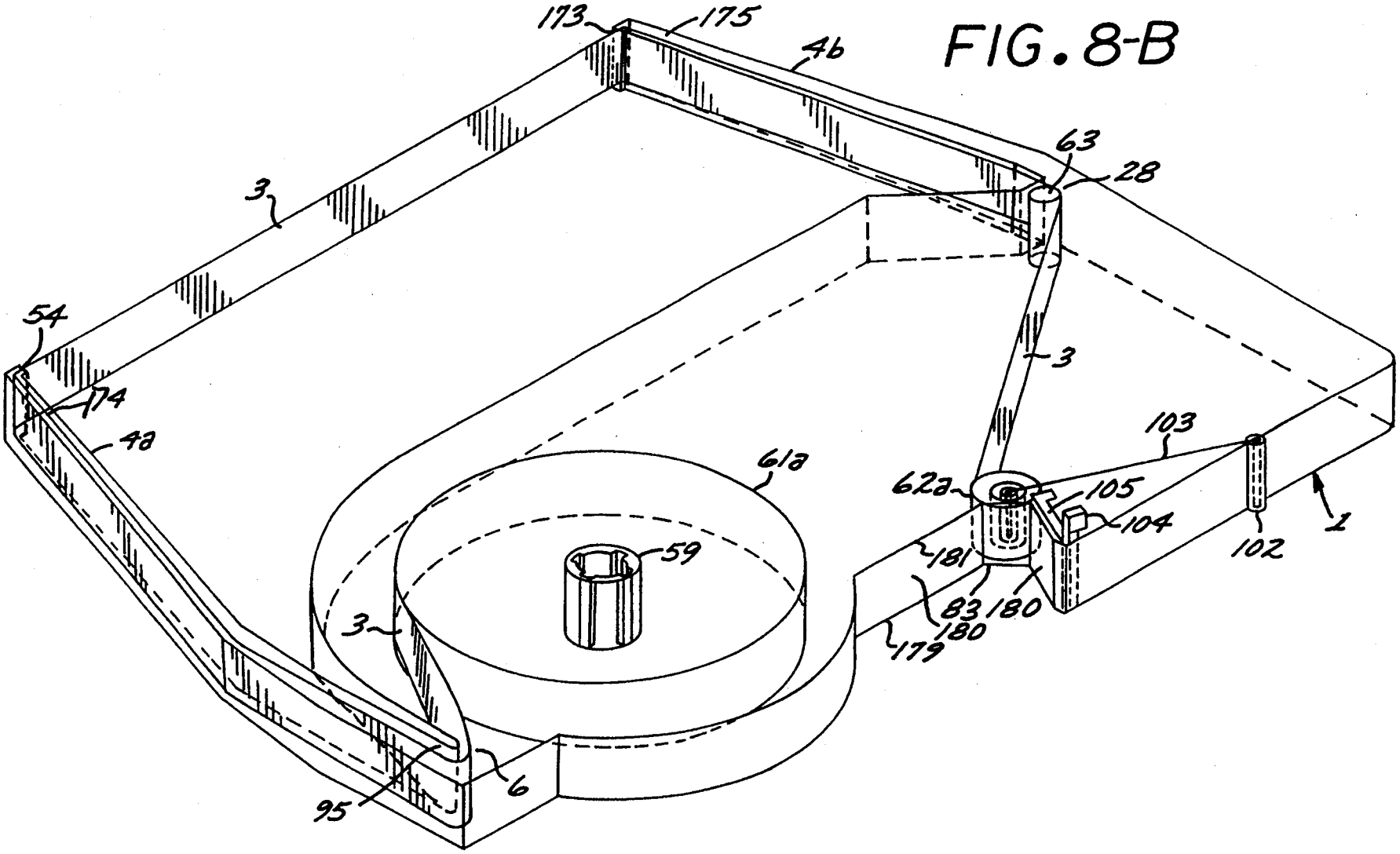
FIG. 8-B

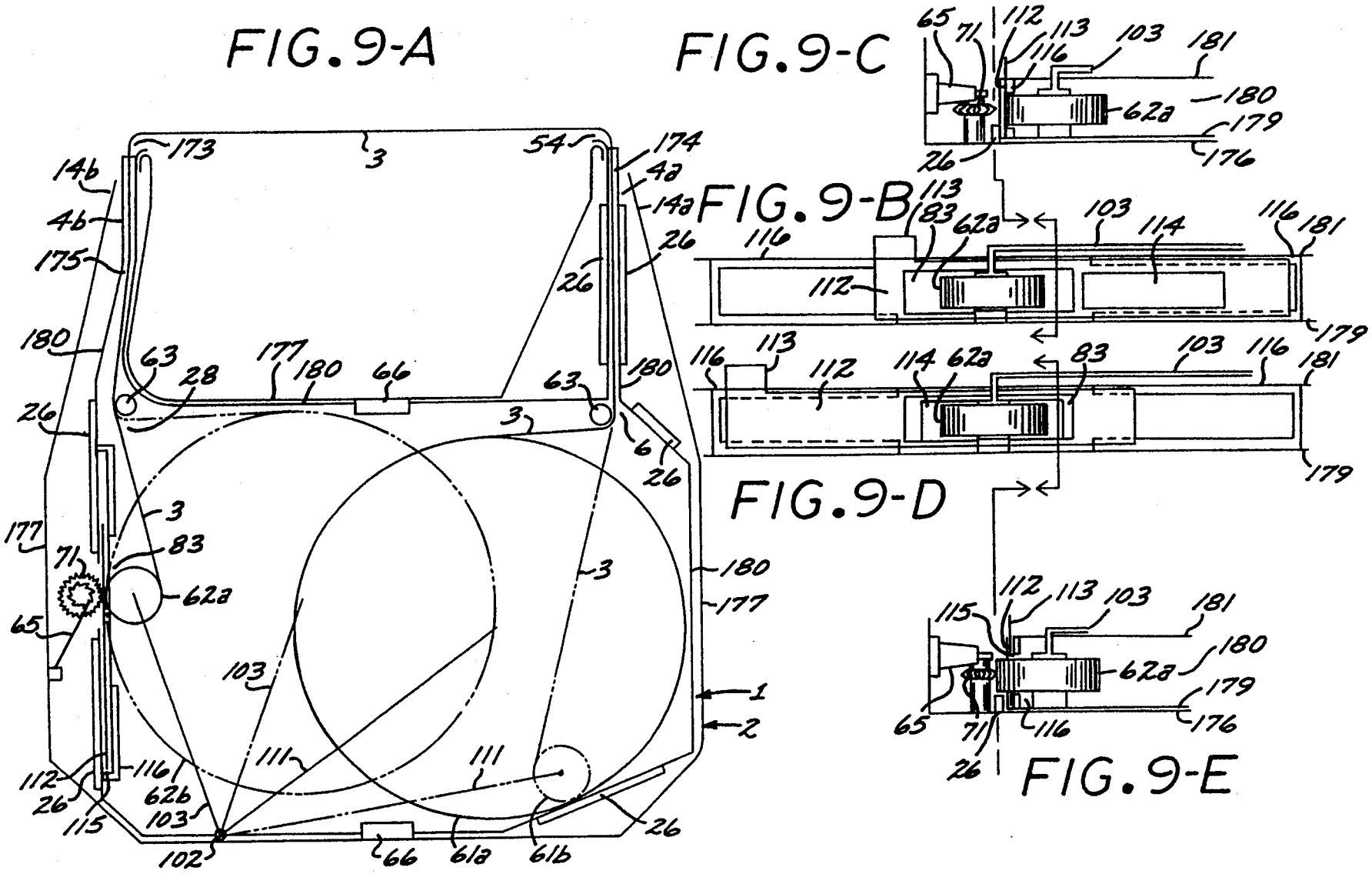
FIG. 9-A
FIG. 9-B
FIG. 9-C
FIG. 9-D
FIG. 9-E

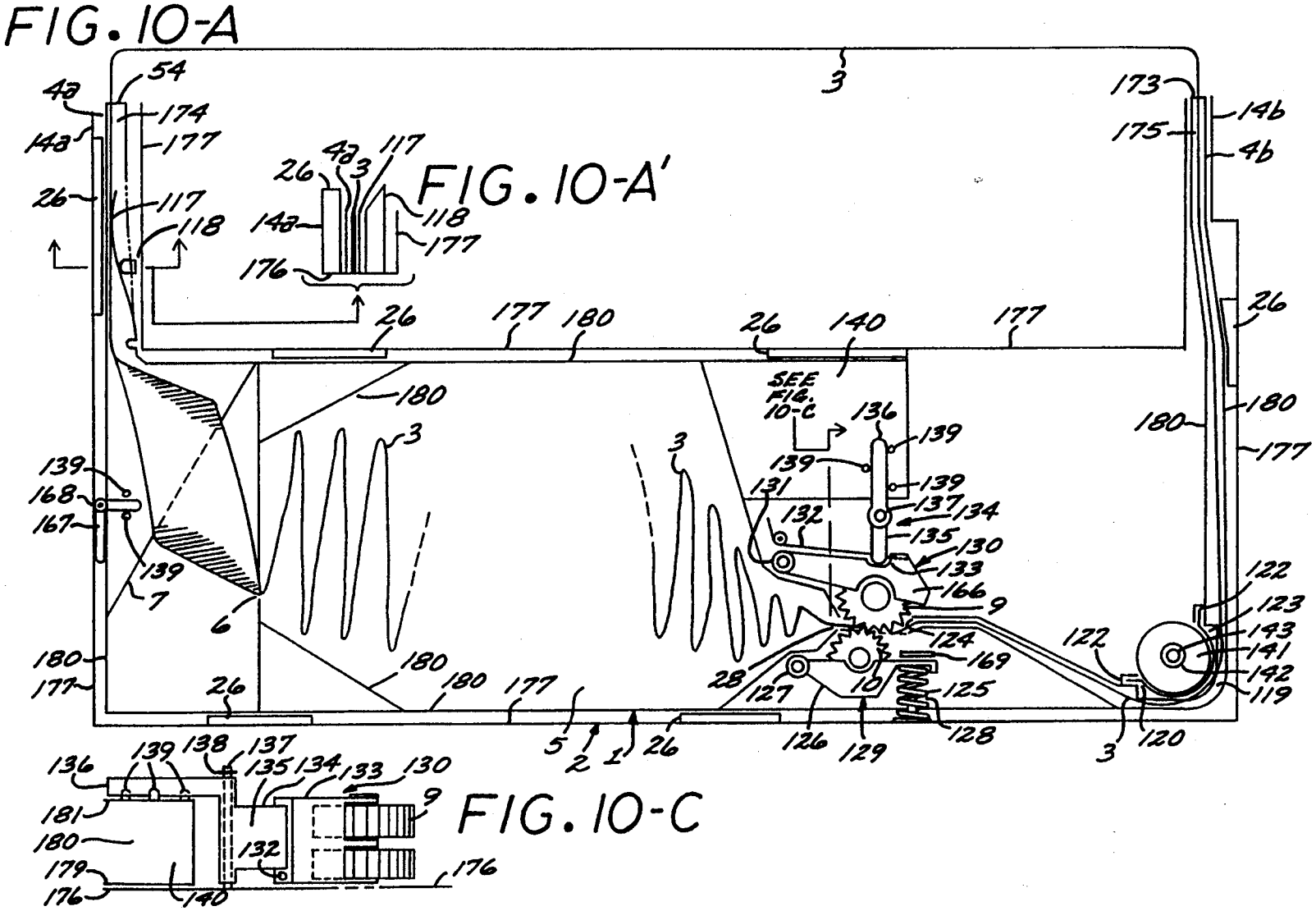
FIG. 10-A
FIG. 10-A'
FIG. 10-C

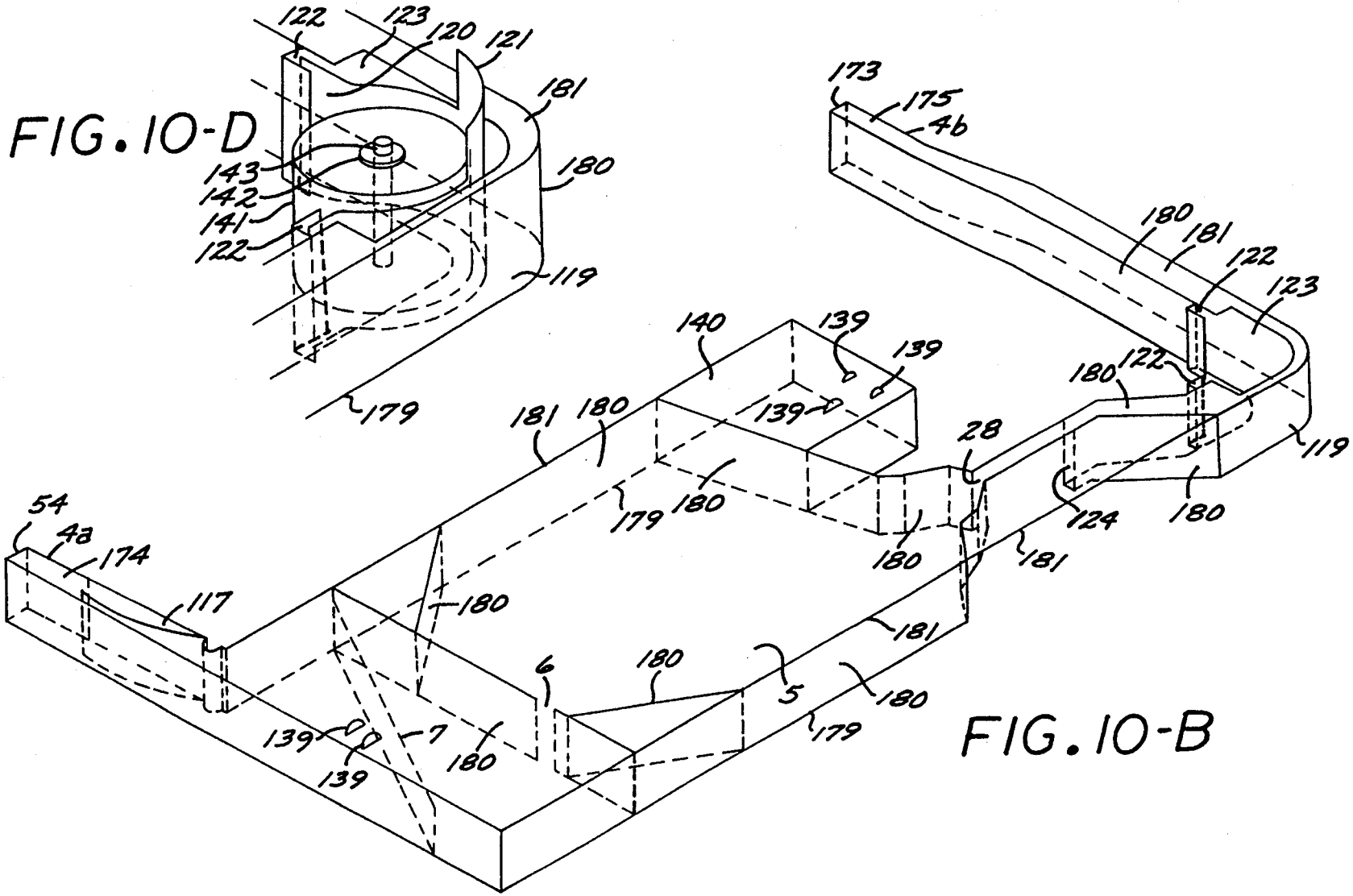
FIG. 10-B
FIG. 10-D

DISPOSABLE RIBBON CASSETTE WITHIN A RELOADABLE CARTRIDGE

This is a continuation of application Ser. No. 08/044,306, filed on Apr. 6, 1993, now abandoned.

BACKGROUND

1. Technical Field

This invention relates to a disposable ribbon cartridge system, specifically a disposable ribbon cassette which is contained within a reloadable cartridge which is for use in printing devices such as computer printers, typewriters, office machines, stenographic printers, and other printing devices.

2. Description of Related Art

Refillable ink ribbon cartridges are known in two arts as shown in U.S. Pat. No. 5,127,750 and also U.S. Pat. No. 4,213,715.

In U.S. Pat. No. 5,127,750 to Burgin (1992), a two-part ribbon cartridge system is described. The disposable ribbon cassette, or ink ribbon cassette as it is called in that invention, is contained within a cartridge, or an adapter as it is called in that invention. The adapter "remains permanently inserted in the typewriter" or in another embodiment of that invention "is a component part of a typewriter." The adapter includes a ribbon drive mechanism for advancing the ink ribbon cassette. The adapter also includes a body portion and two extending legs, centering pins, and a ribbon tensioning device. The cassette is as formed with a body portion and two protruding legs with guiding elements to guide the ribbon across the free end of the legs. A drive wheel is rotatably mounted on a spring loaded arm to pull the ribbon through the cartridge and the arm is rotatable about a drive pin. When the ribbon supply has been depleted, the permanently installed adapter remains in the typewriter, the depleted cassette is removed, and a new cassette is replaced into the adapter.

In one embodiment of that invention, the device requires a permanent installation in the typewriter in order to be used. This implicitly requires that the existing typewriter, one not specially constructed to accommodate such a device, must be specially modified in order to permit the installation of the permanent adapter. In another embodiment of that invention, it is again implicitly required that the typewriter must be specially modified, and even perhaps specially designed and built, to permit the installation of the permanent adapter as "a component part." As the device cannot be utilized in typewriters which have not been specially modified, or designed and built, to accommodate it, it is of no use nor applicable to the existing typewriters which are already in use.

Most, if not nearly all, typewriters currently commercially available utilize a reloadable ribbon cartridge; that is, a ribbon cartridge which can be inserted to and removed from an existing cartridge fitting on the typewriter. A reloadable cartridge arrangement is the current and popular art and it is not practical, nor probably possible in most instances, to try to modify these existing typewriters to accommodate a permanent adapter.

An additional limitation of this device is that it only addresses typewriters which utilize fixed-spool ribbon arrangements; specifically, typewriters with fixed-core spool mountings. The device in any embodiment does not address, nor is it applicable to, the requirements of endless loop ribbon arrangements and non-fixed-core spool mounted ribbon arrangements.

In U.S. Pat. No. 4,213,715 to Haftmann and Schmeykal (1980), a two-part ribbon cartridge system is described. The disposable ribbon cassette, or throw-away magazine as it is called in that invention, is contained within a cartridge, or an ink ribbon guide device as it is called in that invention. The guide device contains both the guide elements and the drive elements necessary for the movement of the ink ribbon through one or more printing regions. The throw-away magazine of this device is only a storage container for the ink ribbon which is stored as loops lying one on another within it. The throw-away magazine contains no substantive structure nor parts beyond merely being a storage receptacle for the ink ribbon. The throw-away magazine is inserted in a recess in the ink ribbon guide device. The recess is shaped to correspond with the throw-away magazine outline. The ribbon guide device has both guide elements and driving elements for the ink ribbon in the region of the inlet and outlet opening of the throw-away magazine.

A limitation of this device is that it requires, after the installation of the throw-away magazine into the guide device, the hand threading of the ribbon from the throw-away magazine through the various guide elements and ribbon drive components of the guide device. This hand threading presents problems as it is time consuming, extraordinarily messy, and difficult for those without a degree of manual dexterity. Variations of this type of device, that is reloadable ribbon loops within a reloadable cartridge but requiring hand threading of the ribbon within the cartridge, have been commercially available for many years and have never achieved a high level of commercial acceptance due to the problems cited before. An additional limitation of this device is that it only address endless loop ribbon cartridges. The device does not address any spool-type cartridges.

OBJECTS AND ADVANTAGES

Accordingly, the several objects and advantages of my invention of a disposable ribbon cassette within a reloadable cartridge are to provide a device which:

(a) in numerous and varied embodiments and adaptations of the invention, both shown and not shown, is easily retrofittable to the many types and numbers of both existing computer printers, typewriters, office machines, stenographic printers, and other printing devices;

(b) in numerous and varied embodiments and adaptations of the invention, both shown and not shown, can be applied to spool-type ribbon cartridges, endless loop-type ribbon cartridges, and other ribbon arrangements of ribbons having an end but utilizing a reloadable cartridge configuration;

(c) does not require the hand threading of the ribbon around the ribbon guide devices, drive devices, and reinking devices of the numerous and varied embodiments and adaptations of the invention, both shown and not shown;

(d) provides an economical, efficient, and clean method of replacing a spent or depleted ribbon within a reloadable cartridge;

(e) provides a disposable cassette which is easily and cleanly inserted into the main reloadable cartridge;

(f) does not require the modification or alteration of existing computer printers, typewriters, office machines, stenographic printers, and other printing devices which utilize a reloadable cartridge;

(g) does not require a permanent adapter be constructed and affixed or mounted to existing computer printers, typewriters, office machines, stenographic printers, and other printing devices in order to utilize the benefit of this invention;

(h) allows the components comprising the bulk of the reloadable cartridge, usually including items such as the body, gears, springs, and tensioning devices, to be used over again after the depletion of the ribbon, thereby providing a significant savings to the reloadable cartridge user.

SUMMARY

This present invention is a disposable ribbon cartridge system, specifically a disposable ribbon cassette which is contained within a reloadable cartridge which is for use in printing devices such as computer printers, typewriters, office machines, stenographic printers, and other printing devices.

This invention is a two-part reloadable ribbon cartridge system comprising a reloadable cartridge and a disposable ribbon cassette. The reloadable cartridge is capable of being inserted to and removed from, not permanently mounted within nor affixed to, a printing device. The printing device requires no modification in order to utilize this invention. The reloadable cartridge in many embodiments comprises the drive and tensioning elements necessary to convey the ribbon within the cassette and to a printing mechanism. The cassette contains, in addition to the ribbon, sufficient guide paths and other structure and elements to eliminate the necessity of hand threading the ribbon within the reloadable cartridge. The standard reloadable ribbon cartridge currently used with a corresponding printing device may be easily substituted with an embodiment of this invention of a two-part reloadable ribbon cartridge system.

This invention of a two-part reloadable ribbon cartridge system provides an economical, efficient, and clean method of separating the ribbon, a spendable element, of a reloadable ribbon cartridge from those elements which can be continued to be utilized after the ribbon has been spent.

Additionally, various embodiments of this invention, can be applied to spool-type ribbon cartridges, endless loop-type ribbon cartridges, and other ribbon arrangements of ribbons having an end but utilizing a reloadable cartridge configuration. Many of these embodiments are illustrated and described in this Specification.

In detail, the present invention is in an embodiment:

1. A ribbon cartridge system for use on a printing device comprising a reloadable cartridge and a cassette. The reloadable cartridge comprises substantially the cartridge dimensions and construction to permit fit of a cassette. The cassette comprises substantially the cassette dimensions and construction to fit the cartridge, and it is removable from the cartridge.

The cassette has an exit opening and an entry opening. The exit opening is connected to an exit guide path. The entry opening is connected to an entry guide path. Both guide paths connect to a storage chamber. The storage chamber has disposed within it a ribbon. The ribbon is extensible from the storage chamber and is conveyable along the exit guide path and to and out the exit opening. The ribbon then reenters the cassette through the entry opening and is conveyable along the entry guide path back into the storage chamber.

In detail, the present invention is in another embodiment:

2. A ribbon cartridge system for use on a printing device comprising a reloadable cartridge and a cassette. The reloadable cartridge comprises substantially the cartridge dimensions and construction to permit fit of a cassette. The cassette comprises substantially the cassette dimensions and construction to fit the cartridge, and it is removable from the cartridge.

The cassette has an exit opening and an entry opening. The exit opening is connected to an exit guide path. The entry opening is connected to an entry guide path. Both guide paths connect to a storage chamber. The storage chamber has disposed within it a supply spool and a take-up spool. The supply spool contains a ribbon. The take-up spool is for gathering the ribbon. The ribbon is extensible from the supply spool in the storage chamber and is conveyable along the exit guide path and to and out the exit opening. The ribbon then reenters the cassette through the entry opening and is conveyable along the entry guide path, back into the storage chamber, and gathered onto the take-up spool.

In detail, the present invention is in another embodiment:

3. A ribbon cartridge system for use on a printing device comprising a reloadable cartridge and a cassette. The reloadable cartridge comprises substantially the cartridge dimensions and construction to permit fit of a cassette. The cassette comprises substantially the cassette dimensions and construction to fit the cartridge, and it is removable from the cartridge.

The cassette has an exit opening and an entry opening. The exit opening is connected to an exit guide path. The exit guide path is connected to a storage chamber. The entry opening is connected to the storage chamber. The storage chamber has disposed within it a ribbon. The ribbon is extensible from the storage chamber and is conveyable along the exit guide path and to and out the exit opening. The ribbon reenters the cassette through the entry opening and back into the storage chamber.

Other elements required for the functioning of this invention are added by specific embodiment requirements. These elements comprise devices for:

(a) ribbon tensioning,
(b) mobius twist,
(c) retaining the cassette within the cartridge,
(d) reinking of the ribbon,
(e) shielding the ribbon from the reinking device,
(f) a top,
(g) assisting removal of the cassette from the cartridge,
(h) rotary transmission—including various gears, bands, drive cores, drive rollers, and other such methods—for the conveying the ribbon,
(i) biasing placement of at least one rotary transmission element by a pivotable armature,
(j) biasing placement of at least one rotary transmission element by a lever,
(k) biasing placement of at least one spool by a pivotable armature,
(l) connecting at least two spools to keep at a movably constant distance to each other, and
(m) braking the ribbon.

The scope of this invention of the disposable ribbon cartridge system is not limited to a single specific type nor design of printing device. Additionally, it is not limited to a single nor specific type of cartridge used within the multiplicity of printing devices. Further, it is not limited to the embodiments illustrated within this Specification.

It is an object of this Specification to illustrate as many of the preferred embodiments as practical, and to cover those which fall within the scope of this invention but not illustrated. It is not practical to illustrate all embodiments of this invention due to the multiplicity of printing devices in existence on which this invention may be used. Therefore, it is anticipated and claimed by this invention that the individual elements, and/or their equivalents, of the many embodiments shown may be combined to form a multiplicity of other embodiments, which for space sakes, is not practical to illustrate in this Specification. As such, the exclusion of the numerous variations of other numerous embodiments and the various and numerous combinations of the individual elements of the embodiments of this invention should not be viewed as a limitation of this invention.

This invention is applicable to, anticipates, and incorporates many different types of printers. As an example, this specifically includes, but is not limited to, printers such as dot matrix, daisy wheel, stenographic, and thermal. Any printer which incorporates a reloadable ribbon cartridge may utilize this invention.

This invention is applicable to, anticipates, and incorporates many different equivalents of the elements of a ribbon cartridge. As a first example, this specifically includes, but is not limited to, the various ribbons used including inked nylon, thermal, film, and correctable film. As a second example, this specifically includes, but is not limited to, the various types and designs of, and materials used for, the rotatable gears including foam and toothed variations.

This invention is applicable to, anticipates, and incorporates many different locations of the various elements of the multiplicity of embodiments. This specifically includes, but is not limited to, the placement of gears, other rotary transmission methods, spacing methods, positioning methods, pivoting armatures, levers, mobius methods, retaining methods, shielding methods, braking methods, and tensioning methods being located in the cartridge, cassette, top, or external to the cartridge system.

This invention is applicable to, anticipates, and incorporates many different combinations of the various elements of the multiplicity of embodiments. This specifically includes, but is not limited to, the combination of gears, other rotary transmission methods, spacing methods, positioning methods, ribbon guide paths, pivoting armatures, levers, mobius methods, retaining methods, shielding methods, braking methods, and tensioning methods being combined in the cartridge, cassette, top, or external to the cartridge system.

These and other features, aspects, objects, and advantages of my invention will become better understood from a consideration of the ensuing description, appended claims, and as accompartying drawings.

BRIEF DESCRIPTION OF THE DRAWINGS

FIG. 1-A is a top view of the ribbon cassette within a reloadable cartridge.

FIG. 1-B is a top view of the ribbon cassette.

FIG. 1-C is a top perspective view of the ribbon cassette.

FIG. 1-D is a top view of the reloadable cartridge.

FIG. 1-E is a side view of the cover of the reloadable cartridge.

FIG. 1-F is a side view of the drive and idler gears in open position.

FIG. 1-G is a side view of the drive and idler gears in closed position.

FIG. 1-H is a side view of the drive and idler gears with ribbon engaged.

FIG. 2-B is top perspective view of the ribbon cassette.

FIG. 2-C is a side view of the cover of the reloadable cartridge.

FIG. 2-D is a side view of the drive and idler gears.

FIG. 3-B is a top view of the ribbon cassette within a reloadable cartridge.

FIG. 3-C is a top view of the extended ribbon brake within the reloadable cartridge.

FIG. 3-D is a side view of the cover of the reloadable cartridge.

FIG. 4-A is a top view of the ribbon cassette within a reloadable cartridge in a fourth embodiment.

FIG. 4-B is a top view of the ribbon cassette.

FIG. 4-C is top perspective view of the ribbon cassette.

FIG. 4-D is a top view of the reloadable cartridge.

FIG. 4-E is a side view of the ribbon cassette.

FIG. 4-F is a side view of the ribbon cassette within a reloadable cartridge.

FIG. 4-G is a side view of the reloadable cartridge.

FIG. 5-A is a top view of the ribbon cassette within a reloadable cartridge with the drive wheel engaging the ribbon spool in a fifth embodiment.

FIG. 5-B is a top view of the ribbon cassette within a reloadable cartridge with the ribbon spool in the load position.

FIG. 5-C is a side perspective view of the ribbon cassette.

FIG. 5-D is a side view of the swing arm with the spool within the ribbon cassette mounted upon it.

FIG. 5-E is a side view of a portion of the ribbon cassette within a reloadable cartridge.

FIG. 6-A is a top view of the ribbon cassette within a reloadable cartridge in a sixth embodiment.

FIG. 6-B is a top view of the ribbon cassette.

FIG. 6-C is a side view of the drive gear within the reloadable cartridge with the ribbon cassette in place.

FIG. 7-A is a top view of the ribbon cassette within a reloadable cartridge in a seventh embodiment.

FIG. 7-B is a top view of the ribbon cassette.

FIG. 7-C is a top perspective view of the ribbon cassette.

FIG. 7-D is a top view of the reloadable cartridge.

FIG. 7-E is a side view of a portion of the swing arm with the spools of the ribbon cassette mounted upon it within the reloadable cartridge.

FIG. 7-F is a side view of a portion of the swing arm with the spools of the ribbon cassette mounted upon it within the reloadable cartridge.

FIG. 8-A is a top view of the ribbon cassette within a reloadable cartridge in an eighth embodiment.

FIG. 8-B is a top perspective view of the ribbon cassette.

FIG. 8-C is a top view of the drive gear engaging the ribbon spool.

FIG. 8-D is a top view of the drive gear with the ribbon spool not engaged.

FIG. 8-E is a top view of the drive gear engaging the ribbon spool.

FIG. 8-F is a side view of the drive gear engaging the ribbon spool.

FIG. 8-G is a top view of the drive gear with the ribbon spool not engaged.

FIG. 8-H is side view of the drive gear with the ribbon spool not engaged.

FIG. 9-A is a top view of the ribbon cassette within a reloadable cartridge.

FIG. 9-B is a side view of a portion of the ribbon cassette within a reloadable cartridge with the slide gate closed in a ninth embodiment.

FIG. 9-C is front view of a portion of the ribbon cassette within a reloadable cartridge with the slide gate closed.

FIG. 9-D is a side view of a portion of the ribbon cassette within a reloadable cartridge with the slide gate open.

FIG. 9-E is front view of a portion of the ribbon cassette within a reloadable cartridge with the slide gate open.

FIG. 10-A is a top view of ribbon cassette within a reloadable cartridge in a tenth embodiment.

FIG. 10-A' is a cutaway front view of a portion of a reloadable cartridge.

FIG. 10-B is a top perspective view of the ribbon cassette.

FIG. 10-C is a side view of a portion of the drive gear and ribbon cassette.

FIG. 10-D is a top perspective view of a portion of the ribbon cassette showing the removable shield.

Figure 2D:
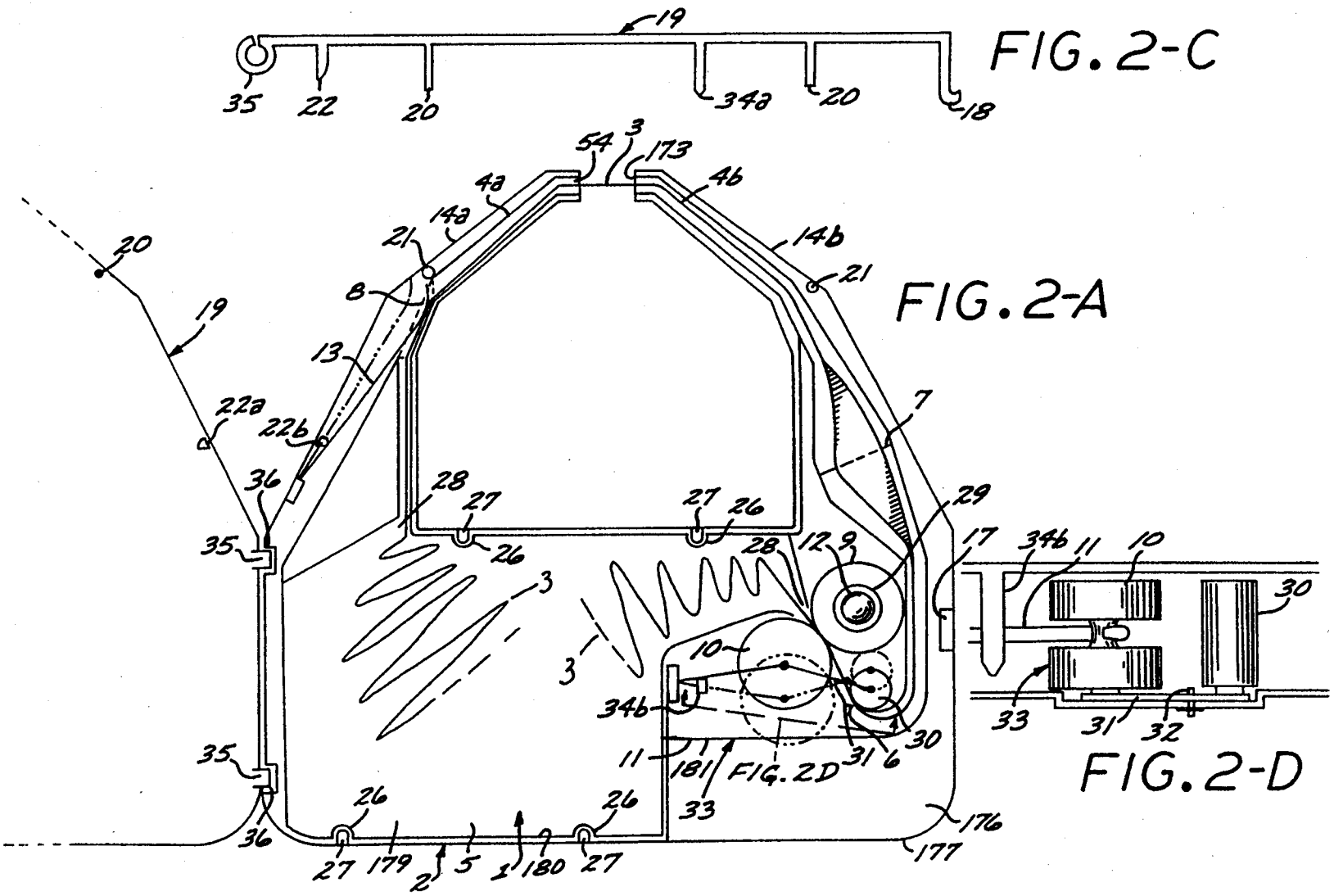
FIG. 2-A is a top view of the ribbon cassette within a reloadable cartridge in a second embodiment.

| Reference Numerals In Drawings | |
|---|---|
| 1 | Ribbon cassette |
| 2 | Reloadable cartridge |
| 3 | Ribbon |
| 4a | Exit protruding leg |
| 4b | Entry protruding leg |
| 5 | Storage chamber |
| 6 | Opening |
| 7 | Mobius ridge |
| 8 | External opening |
| 9 | Drive gear |
| 10 | Idler gear |
| 11 | Gear spring |
| 12 | Drive pin |
| 13 | Tensioning spring |
| 14a | Exit support leg |
| 14b | Entry support leg |
| 15 | Hinge receptacle |
| 16 | Hinge pin |
| 17 | Latch receptacle |
| 18 | Latch pin |
| 19 | Cover |
| 20 | Positioning pin |
| 21 | Pin receptacle |
| 22a | Pin |
| 22b | In-place pin |
| 23 | Gear pin |
| 24 | Idler gear well |
| 25 | Positioning notch |
| 26 | Positioning post |
| 27 | Pull tab |
| 28 | Storage opening |
| 29 | Gear hole |
| 30 | Positioning gear |

-continued

| Reference Numerals In Drawings | |
|---|---|
| 31 | Pivotable arm |
| 32 | Mounting pin |
| 33 | Gear assembly |
| 34a | Assembly pin |
| 34b | In-place assembly pin |
| 35 | Curved hinge |
| 36 | Cover slot |
| 37 | External drive gear |
| 38 | Tension plate |
| 39 | Chamber |
| 40 | Plate spring |
| 41 | Piston |
| 42 | Piston wall |
| 43 | Piston pin |
| 44 | Piston receptacle |
| 45 | Cavity |
| 46 | Cap stop |
| 47 | Chamber backstop |
| 48 | Snap pin |
| 49 | Snap pin receptacle |
| 50 | Cutaway |
| 51 | Tension plate assembly |
| 53 | Enclosure |
| 54 | Exit opening |
| 55 | Gear teeth slot |
| 56 | Cutaway opening |
| 57 | Gear drive |
| 58 | Take-up drive |
| 59 | Feed core |
| 60 | Take-up core |
| 61a | Feed spool |
| 61b | Depleted feed spool |
| 62a | Take-up spool |
| 62b | Full take-up spool |
| 63 | Guide pin |
| 64 | Blocking disc |
| 65 | Blocking plate |
| 66 | Snap latch |
| 67 | Feed pin |
| 68 | Take-up pin |
| 69 | Ribbon tensioning element |
| 70 | Positioning bump |
| 71 | Drive roller |
| 72 | Swing arm |
| 73 | Pivot |
| 74 | Axis |
| 75 | Assembly spring |
| 76 | Spring stop |
| 77 | Arm spring stop |
| 78 | Depression |
| 79 | Guide slot |
| 80 | Arm opening |
| 81 | Hook |
| 82 | Catch |
| 83 | Drive opening |
| 84 | Spool groove |
| 85a | Embossed notch |
| 85b | Embossed channel |
| 86 | Drive |
| 87 | Second drive |
| 88 | Holder |
| 89 | Holder axis |
| 90 | Drive band |
| 91 | Groove |
| 92 | Roller pin |
| 93 | Connector |
| 94 | Core opening |
| 95 | Guide |
| 96 | Tension guide |
| 97 | Arm assembly |
| 98 | Retainer |
| 99 | Spool spring arm |
| 100 | Spool spring |
| 101 | Spool spring end |
| 102 | Spring axis |
| 103 | Take-up spool spring |
| 104 | Slide spacer |
| 105 | Spacer groove |
| 106 | Non-engaged position |
| 107 | Engaged position |
| 108 | Twist spacer |

-continued

| Reference Numerals In Drawings | |
|---|---|
| 109 | Spacer axis |
| 110 | Leg support |
| 111 | Feed spool spring |
| 112 | Slide |
| 113 | Slide tab |
| 114 | Slide opening |
| 115 | Channel |
| 116 | Channel guide |
| 117 | Tension flap |
| 118 | Post |
| 119 | Path |
| 120 | Shield |
| 121 | Shield tab |
| 122 | Slot |
| 123 | Shield opening |
| 124 | Path opening |
| 125 | Gear assembly spring |
| 126 | Gear housing |
| 127 | Gear assembly axis |
| 128 | Spring retainer |
| 129 | Idler gear assembly |
| 130 | Drive gear assembly |
| 131 | Drive gear assembly axis |
| 132 | Drive gear assembly spring |
| 133 | Notch |
| 134 | Latch assembly |
| 135 | Latch arm |
| 136 | Latch handle |
| 137 | Latch axis |
| 138 | Latch retainer |
| 139 | Bump |
| 140 | Cassette section |
| 141 | Transfer roller |
| 142 | Roller retainer |
| 143 | Roller post |
| 165 | Hinged arm |
| 166 | Drive gear housing |
| 167 | Retaining latch |
| 168 | Retainer axis |
| 169 | Block |
| 171 | Transfer roller assembly |
| 173 | Entry opening |
| 174 | Exit guide path |
| 175 | Entry guide path |
| 176 | Cartridge base |
| 177 | Cartridge wall |
| 178 | Inside wall |
| 179 | Cassette base |
| 180 | Cassette wall |
| 181 | Covering |
| 182 | Bottom |
| 183 | Guide hinge |
| 184 | Tip |

FIRST EMBODIMENT

Preferred Embodiment of Invention

The First Embodiment of this invention is the Best Mode or preferred of this invention.

A type of embodiment of this invention is illustrated in FIGS. 1-A through 1-H which illustrate various components of a disposable ribbon cassette within a reloadable cartridge for insertion into computer printers, typewriters, office machines, stenographic printers, or other printing devices utilizing an endless loop ribbon configuration or a ribbon with an end but utilizing a reloadable cartridge.

FIG. 1-A is a top view of a disposable ribbon cassette within a reloadable cartridge. A ribbon cassette 1 is located within a reloadable cartridge 2.

Reloadable cartridge 2 is designed to be reusable and able to fit and be reloadable into a printing device which is not shown in any embodiment illustration. Ribbon cassette 1, containing a ribbon 3, is disposable and replaced after depletion of the ribbon 3. In this embodiment, the mechanical parts needed to convey or drive, and to tension a ribbon are housed in reloadable cartridge 2.

In this and all embodiments, ribbon cassette 1 is designed with dimensions to fit within reloadable cartridge 2. Such dimensions are not of illustrative or descriptive issue to these embodiments as they vary to the printing device to which this invention will be specifically adapted.

It is considered that the best material for ribbon cassette 1 in this embodiment, as in all other embodiments in this Specification, is a thermoformed thermoplastic. An injection molded plastic may also be used, however a thermoformed thermoplastic is preferred as it may be less expensive. It is anticipated that other materials—including but not limited to cardboard, paperboard, and other plastics—might also be used to construct ribbon cassette 1. Therefore, the material of ribbon cassette 1, as is similar for all components and elements of this invention, should be determined by the specific embodiment's requirements and any specification of a particular material should not be construed as a limitation of scope of this invention.

In this embodiment, as in all other embodiments in this Specification, reloadable cartridge 2 is comprised of injection molded plastic. It is anticipated that other materials, including but not limited to metal and other plastics, might also be used to construct reloadable cartridge 2. Therefore, the material of reloadable cartridge 2 should be determined by the specific embodiment's requirements.

FIGS. 1-B and 1-C illustrate ribbon cassette 1. FIG. 1-B shows cassette 1 with ribbon 3 threaded through it and FIG. 1-C shows cassette 1 without ribbon 3 inserted. The purpose of illustrating cassette 1 without ribbon 3 is to better show the details of cassette 1. Cassette 1 comprises a cassette base 179 with a cassette wall 180 at certain positions upon the base 179. A coveting 181 is positioned on top of the cassette 1 to form a container. A ribbon 3 is disposed within cassette 1. The design of cassette 1 allows for the extensibility and conveyance of the ribbon 3 through cassette 1. Cassette 1, in this and remaining embodiments, has ribbon 3 inserted and threaded into it at time of manufacture. Such ribbon threading is similar to that used in standard reloadable ribbon cartridges as used and known in the art.

Within cassette 1, ribbon 3 is housed in a storage chamber 5 in loops known in the art. Ribbon 3 threads out of storage chamber 5 through an opening 6 and twists over a mobius ridge 7 which purpose is to place a mobius twist in the ribbon 3. Such mobius twist is known in the art as a method of extending the printing life of ribbon 3. Ribbon 3 is threaded past an external opening 8 and into an exit guide path 174. Exit guide path 174 is located in an exit protruding leg 4*a*. Ribbon 3 is then threaded out of cassette 1 through an exit opening 54 where it is capable of being engaged by a printing mechanism which is not shown in these illustrations. In this and all embodiments, such a printing mechanism is known in the art, is not part of this invention, and it is not illustrated. Ribbon 3 then reenters cassette 1 through an entry opening 173 and is threaded through an entry guide path 175 which is located in an entry protruding leg 4*b*. Ribbon 3 is then threaded back into storage chamber 5 through a storage opening 28.

Cassette 1 has a positioning notch 25 which fits into a positioning post 26 in cartridge 2. Cassette 1 also has a pull tab 27, typically constructed of the same material as cassette 1, which is for easy removal of cassette 1 from cartridge 2 after the ribbon 3 has been depleted.

Cartridge 2, as shown in FIG. 1-D, has a cartridge base 176 and a cartridge wail 177 on all sides of base 176. In this embodiment, cartridge 2 contains a drive gear 9 which is rotatably mounted on a drive pin 12 which is affixed to base 176 in a manner known in the art. An idler gear 10, affixed to base 176 in a manner known in the art, is laterally movable and has a gear spring 11, typically made of a round metal spring, exerting force upon it for such movement. Gear spring 11 is fixed to the reloadable cartridge 2 in a manner known in the art. A tensioning spring 13, typically made of a fiat metal spring, provides tension for a moving ribbon 3. Tensioning spring 13 is fixed to the reloadable cartridge 2 in a manner known in the art. An exit support leg 14*a* and an entry support leg 14*b* are designed to allow placement within them of protruding legs 4*a* and 4*b*. The drive gear 9 and idler gear 10 may be constructed with varying materials and designs such as foam or with gear teeth. The choice of material and design depends on the specific printing device or application for which this invention is to be used. Such choices of material and design implementation are known in the art. In addition, the designs of the gear spring 11 and the tensioning spring 13 are known in the art.

The following parts in FIG. 1-A and 1-D have complementary parts illustrated in FIG. 1-E. A hinge receptacle 15 receives a hinge pin 16 from a cover 19, and a latch receptacle 17 receives a latch pin 18 from the cover 19 upon the closing of the cover 19 on the reloadable cartridge 2. Hinge receptacle 15, hinge pin 16, latch receptacle 17, and latch pin 18 form a retaining means for cover 19. Cover 19 is positioned upon cartridge 2 by way of a positioning pin 20 in cover 19 being placed in a pin receptacle 21 in cartridge 2. Cover 19 is typically made of the same material as cartridge 2, such as an injection molded plastic. Tensioning spring 13 is laterally movable by a pin 22*a* which is in cover 19. And, idler gear 10 is laterally movable by a gear pin 23 which is also in cover 19.

FIGS. 1-F through 1-H illustrate the mechanism of positioning idler gear 10 against drive gear 9. As shown in FIG. 1-F, a gear pin 23 on cover 19 fits into an idler gear well 24 located within idler gear 10. When cover 19 is not positioned on top of cartridge 2, gear spring 11 exerts tension against idler gear 10 to position it away from drive gear 9.

As shown in FIG. 1-G, when cover 19 is positioned upon cartridge 2, pin 23 inserts into gear well 24 thereby moving idler gear 10 into tensional position against drive gear 9. The force of pin 23 within well 24 is greater than that of the force of spring 11. FIG. 1-H shows the operational configuration of cassette 1 within cartridge 2 with cover 19 in place on top of cartridge 2. Ribbon 3 tensionally rests between drive gear 9 and idler gear 10.

When the supply of ribbon 3 is depleted after printing with cassette 1 and cartridge 2, cartridge 2 with cassette 1 is removed from the printing device. Cover 19 is removed from the cartridge 2 by way of releasing latch pin 18 from latch receptacle 17. As cover 19 is removed, gear pin 23 is also withdrawn from an idler gear well 24. This allows the force exerted by gear spring 11 upon idler gear 10 to move gear 10 away from drive gear 9 which is represented by the dash/double-dot lines on FIG. 1-A. This in turn releases tension upon ribbon 3. Also upon removal of cover 19, pin 22*a* disengages from displacing contact with tensioning spring 13 causing spring 13 to move away from and release tension upon ribbon 3 represented by dash/double-dot lines on FIG. 1-A. Cassette 1 is then able to be withdrawn from the cartridge 2 by grasping pull tab 27.

Spent cassette 1 is discarded and a fresh cassette 1 is inserted into cartridge 2. In detail, protruding legs 4*a* and 4*b* insert into support legs 14*a* and 14*b*, positioning notches 25 insert around positioning posts 26, and drive pin 12, on which drive gear 9 is located, is positioned in a gear hole 29. This positions the cassette 1 correctly so cover 19 may then be placed on top of reloadable cartridge 2. Upon placement of cover 19, positioning pins 20 on cover 19 fit into pin receptacles 21 and hinge pin 16 fits into hinge receptacle 15. Upon cover 19 closure, gear pin 23 inserts into idler gear well 24 inside idler gear 10. This causes idler gear 10 to move laterally into position against drive gear 9 causing tension against ribbon 3. Also upon cover 19 closure, pin 22*a* laterally moves tensioning spring 13. This causes spring 13 to be tensioned against ribbon 3 by an in-place pin 22*b* through external opening 8 in the cassette 1.

In operation, the print device causes drive pin 12, and thereby drive gear 9, to rotatably move in ways known in the art. The tension exerted against ribbon 3 by idler gear 10 as it tensionally rests against drive gear 9 is sufficient to convey ribbon 3 upon the rotatable movement of drive gear 9. This rotatable movement conveys ribbon 3 into storage chamber 5 while also drawing out ribbon 3 from storage chamber 5 through opening 6. Ribbon 3 is caused to have a mobius twist as it is drawn over mobius ridge 7. Tension is caused upon ribbon 3 by its contact with tensioning spring 13 through external opening 8. Ribbon 3 is then conveyed through exit guide path 174 located in protruding leg 4*a* and out of the cassette 1 through exit opening 54 where it is engaged with a printing mechanism. A printing mechanism is known in the art and is not shown. After contact with the printing mechanism, ribbon 3 is conveyed back into the cassette 1 through entry opening 173 and into entry guide path 175 located in protruding leg 4*b*. Ribbon 3 then exits protruding leg 4*b*, is engaged and conveyed forward by drive gear 9 and idler gear 10, and is redrawn back into the storage chamber 5 through a storage opening 28. Ribbon 3 is conveyed throughout the cassette 1 through the rotational contact of drive gear 9 and idler gear 10.

SECOND EMBODIMENT

Figure 2B:
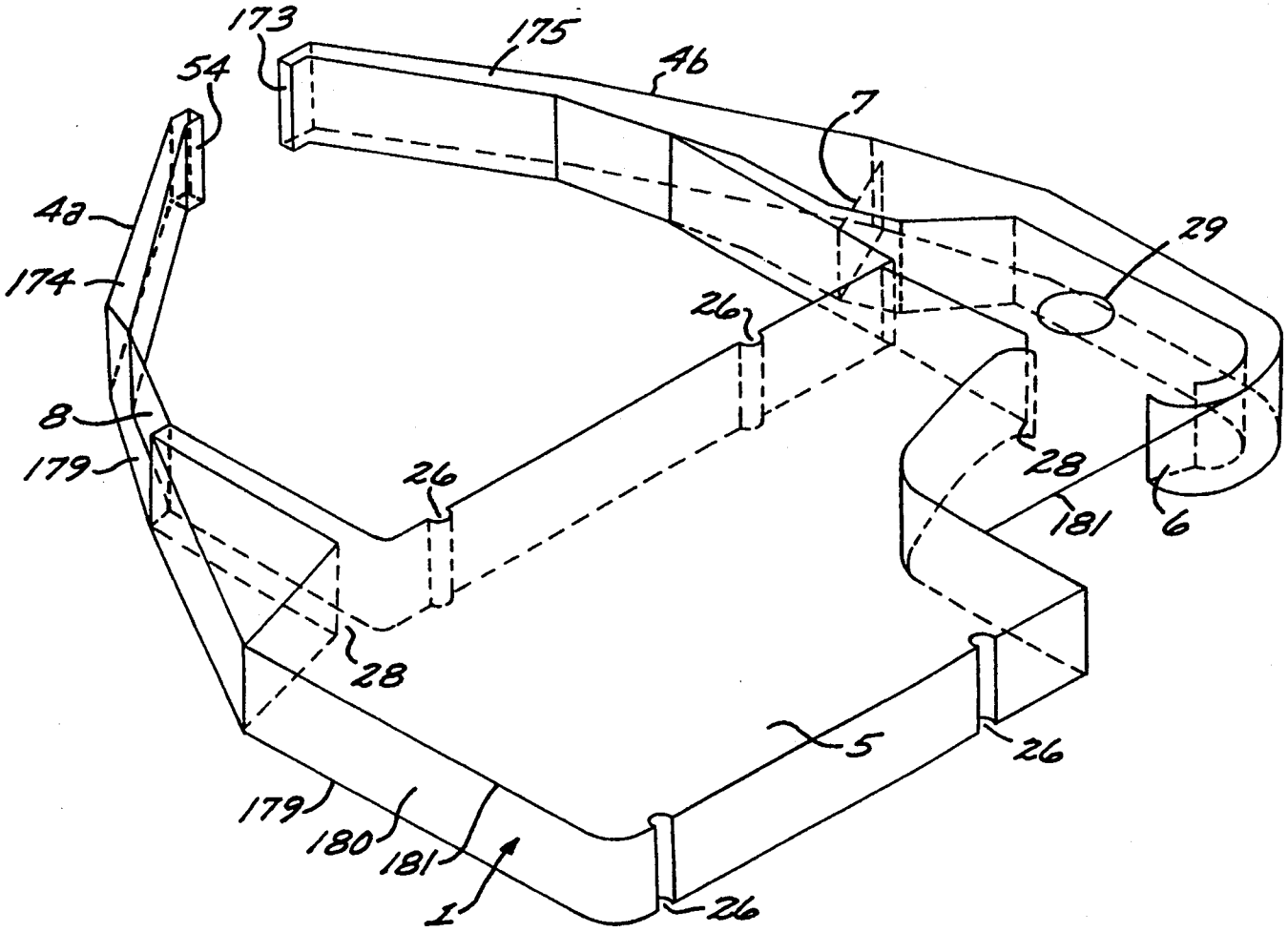

Referring in detail to FIGS. 2-A through 2-D, there is illustrated another embodiment of cassette 1 within cartridge 2 according to this invention. The embodiment detailed in FIGS. 2-A through 2-D is similar to the embodiment in FIGS. 1-A through 1-H and as such only the primary difference is described.

As shown in FIG. 2-A, the primary difference in this embodiment is that the rotary transmission method arrangement for conveying ribbon 3 is somewhat varied. In detail, drive gear 9 remains stationary. Idler gear 10 and a positioning gear 30 are rotatably mounted upon a pivotable arm 31, typically made of injection molded plastic, which is pivotally mounted to the base 176 of the reloadable cartridge 2 with a mounting pin 32 in a manner known in the art.

FIG. 2-B shows cassette 1 without ribbon 3 threaded through it. The purpose of illustrating cassette 1 without ribbon 3 is to better show the details of cassette 1.

As shown in FIG. 2-D, gear spring 11 exerts tension upon a gear assembly 33 comprised of idler gear 10, positioning gear 30, and pivotable arm 31. Gear spring 11 is typically a wire spring of a construction known in the art and connected to cartridge 2 in a manner known in the art.

As shown in FIGS. 2-C and 2-D, an assembly pin 34*a* is located on the cover 19 which purpose is to engage gear spring 11. A hinge is formed by a curved hinge 35 in cover 19 connecting to a cover slot 36 upon the closing of the cover 19 onto the reloadable cartridge 2.

Upon closing of cover 19, as shown in FIGS. 2-A and 2-D, assembly pin 34*a* engages and displaces gear spring 11 causing gear spring 11, shown as an in-place assembly pin 34*b*, to pivot gear assembly 33 and place idler gear 10 in a tensioning position against drive gear 9. Positioning gear 30 is positioned whereby it will facilitate ribbon 3 in entering opening 6.

To remove spent ribbon cassette 1 upon its depletion of ribbon 3, cover 19 is opened and assembly pin 34*a* disengages and does not displace gear spring 11. This causes gear spring 11 to exert tension upon gear assembly 33 and pivot gear assembly 33 away from drive gear 9 to a position whereby the cassette 1 can be easily removed from the cartridge 2. This position is represented by dash/double-dot lines of assembly 33 on FIG. 2-A.

In operation, the primary difference of this embodiment is as follows. Drive gear 9 is caused to rotate by the print device in a manner known in the art. The rotatable movement of gear 9 in turn causes the ribbon 3, held tensionally between gear 9 and idler gear 10, to be conveyed. Ribbon 3 continues to advance around positioning gear 30 and into opening 6.

THIRD EMBODIMENT

Figure 3D:
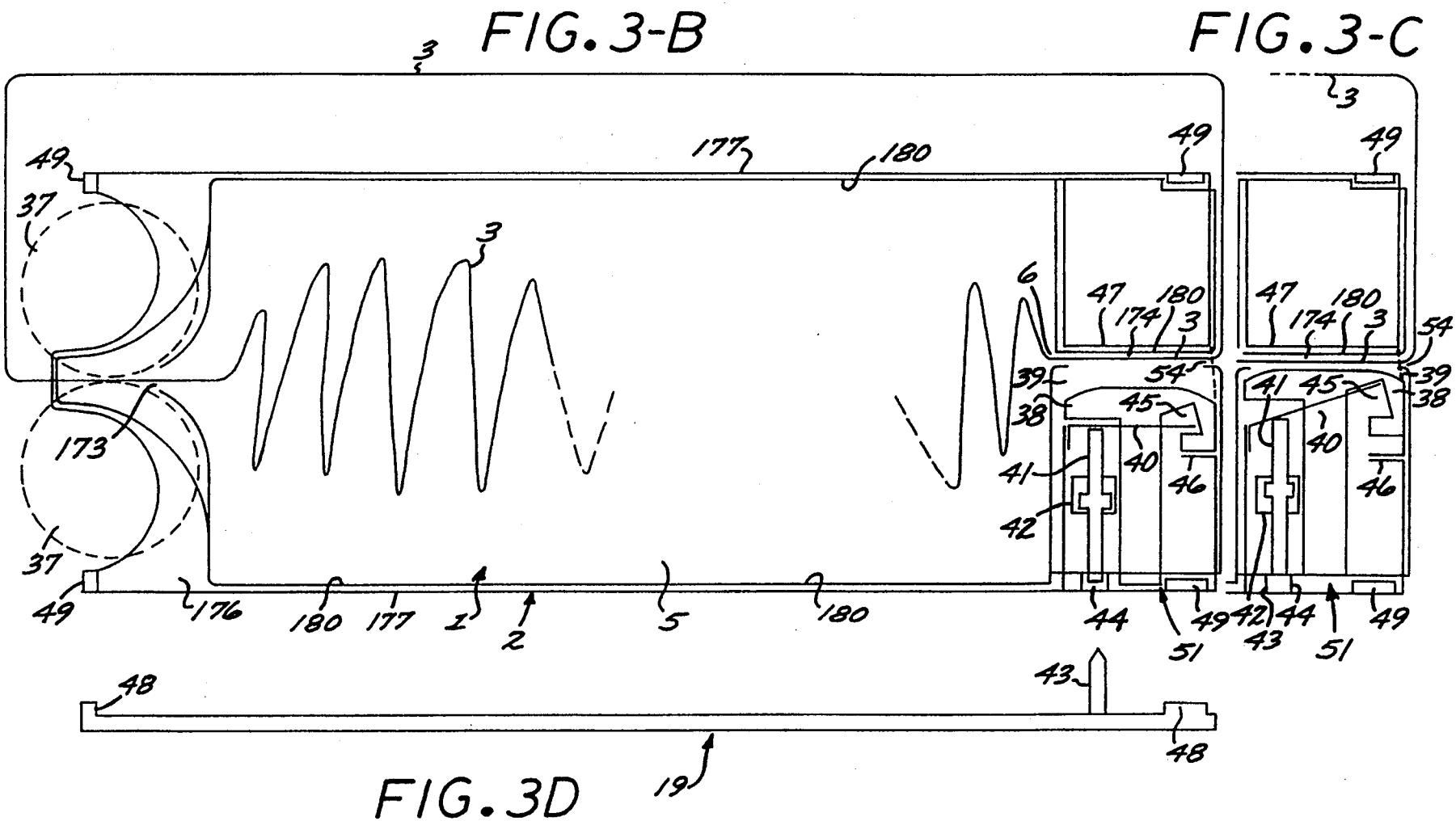
FIG. 3-A is a top perspective view of the ribbon cassette in a third embodiment.

Referring in detail to FIGS. 3-A through 3-D there is illustrated another embodiment of ribbon cassette 1 within reloadable cartridge 2 according to this invention. Reloadable cartridge 2 is designed to be reusable and able to fit and be reloadable into a printing device. Ribbon cassette 1, containing a ribbon 3, is disposable and replaced after depletion of the ribbon 3.

As shown in FIG. 3-B, an external drive gear 37, a quantity of two in this embodiment, is utilized and is represented by dash lines. The drive gears 37 are external to the reloadable cartridge 2 and are part of the construction of a print device. A print device with external drive gears 37 is not illustrated, and it is known in the art.

As shown in FIG. 3-A, cassette 1 incorporates a storage chamber 5 where ribbon 3 is stored in loops known in the art. Ribbon 3 threads through an opening 6 and into exit guide path 174. Ribbon 3 is then threaded out exit opening 54 where it is capable of being engaged by a printing mechanism which is not shown. Ribbon 3 then reenters cassette 1 through entry opening 173 and back into storage chamber 5. Entry opening 173 is connected to storage chamber 5.

As shown in FIGS. 3-B and 3-C, cartridge 2 contains a tension plate assembly 51 for the purpose of tensioning ribbon 3. Tension plate assembly 51 is comprised of a tension plate 38, typically constructed of injection molded plastic, which is within a chamber 39 in reloadable cartridge 2. A plate spring 40, typically made as a flat metal spring, is positioned against tension plate 38 and moved by a piston 41, typically constructed of injection molded plastic, which is movable. Piston 41 is contained in its position by a piston wall 42. A piston pin 43 mounted on cover 19 fits into a piston receptacle 44. Tension plate 38 has a cavity 45 within it to allow movement of plate spring 40. The tension plate 38 rests, in a nonextended position, against a cap stop 46. A chamber backstop 47 serves as a fixed plate for the ribbon 3 to be tensioned against while the tension plate 38 is extended. A snap pin 48 located on the cover 19 fits into a snap pin receptacle 49 located on reloadable cartridge 2 and locks the cover 19 onto the reloadable cartridge 2 when cover 19 is closed.

External drive gears 37 partially extend into cartridge 2 and also through a gear teeth slot 55 into cassette 1. A plurality of gear teeth slots 55 exist in both cassette 1 (FIG. 3A) and cartridge 2. The external drive gears 37 extend enough to allow the conveyance of ribbon 3 through cartridge 2 and cassette 1.

Upon placement of cassette 1 into cartridge 2, a cutaway 50 on cassette 1 slips over tension plate assembly 51. A cutaway opening 56 is present in exit guide path 174 and allows the tensioning of the ribbon 3 against the chamber backstop 47 by the tension plate 38. An enclosure 53, and specifically a cassette wall 180, covers the chamber backstop 47 when cassette 1 is placed within the cartridge 2. An exit opening 54 allows the ribbon 3 to exit the cassette 1. An entry opening 173 allows the ribbon 3 to reenter the storage chamber 5 of the cassette 1.

When the supply of ribbon 3 is depleted during printing with cassette 1 and cartridge 2, cartridge 2 with cassette 1 is removed from the printing device. Cover 19 is removed from cartridge 2 by way of releasing snap pin 48 from snap pin receptacle 49. As cover 19 is removed, piston pin 43 in cover 19 disengages piston 41. This allows plate spring 40 to resume its non-tensioned position and thereby move tension plate 38 to a retracted position. Plate spring 40 moves tension plate 38 by way of its position in cavity 45 within tension plate 38.

Spent cassette 1 is discarded and a fresh cassette 1 is inserted into cartridge 2. In detail, enclosure 53, specifically a cassette wall 180, encloses chamber backstop 47, and cutaway 50 rests over tension plate assembly 51. Upon placement of cover 19, piston pin 43 fits into piston receptacle 44 and engages and displaces piston 41. Piston 41 then displaces plate spring 40 causing tension plate 38 to exert tension against ribbon 3 against cassette wall 180 and chamber backstop 47 through cutaway opening 56. The cassette 1 within cartridge 2 is then reinserted into the printer. The drive teeth, not shown but known in the art, of the external drive gears 37 fit into gear teeth slots 55.

In operation, the printer causes external drive gears 37 to rotatably move in ways known in the art. The rotatable movement of the two external drive gears 37 draws the ribbon 3 out of chamber 5, through opening 6, against tension plate 38, through exit guide path 174, and out exit opening 54. Ribbon 3 is then engaged by the printing mechanism, conveyed through entry opening 173, and back into storage chamber 5.

FOURTH EMBODIMENT

Referring in detail to FIGS. 4-A through 4-G there is illustrated another embodiment of this invention. This embodiment is of a disposable ribbon cassette within a reloadable cartridge for insertion into typewriters, computer printers, office machines, stenographic printers, or other printing devices utilizing a single or multi-spool ribbon configuration.

FIG. 4-A is a top view of a disposable ribbon cassette 1 within a reloadable cartridge 2. Cartridge 2 is designed to be reusable and able to fit and be reloadable into a printing device. Cassette 1, containing ribbon 3, is disposable and replaced after depletion of the ribbon 3. In this embodiment, the mechanical parts needed to drive and tension a ribbon 3 are housed in cartridge 2.

FIG. 4-A illustrates the cassette 1 within the cartridge 2. As shown in FIG. 4-B, 4-C, and 4-E, cassette 1 comprises storage chamber 5 which contains a feed spool 61*a*. Feed spool 61*a*, mounted on a feed core 59, contains ribbon 3. Ribbon 3 winds off feed spool 61*a*, around a guide pin 63, and through exit guide path 174 located in protruding arm 4*a*. Ribbon 3 leaves cassette 1 through exit opening 54 where it is engaged by a printing mechanism which is not illustrated. Ribbon 3 reenters cassette 1 through entry opening 173 and is conveyed along entry guide path 175 which is located in protruding arm 4*b*. Ribbon 3 then threads around guide pin 63 as it reenters storage chamber 5 and is gathered onto a take-up spool 62*a* which is situated around a take-up core 60.

Cartridge 2, as shown in FIGS. 4-D and 4-G, contains a blocking disc 64 with a plurality of teeth arranged around its outer edges, a resilient blocking plate 65 which engages said teeth, and a gear drive 57. Also contained within reloadable cartridge 2, is a take-up drive 58, positioning posts 26, and a snap latch 66. All elements recited as contained within cartridge 2 are known in the art.

Cassette 1 is mounted within cartridge 2, as seen in FIGS. 4-A and 4-F. In detail, feed core 59 is mounted on gear drive 57 and held in place by a notched fit as is known in the art. Take-up core 60 is mounted on take-up drive 58 and also held in place by a notched fit, also as known in the art. Protruding leg 4*a* is situated within support leg 14*a*, and protruding leg 4*b* is situated within support leg 14*b*. Positioning posts 26 keep cassette 1 positioned inside cartridge 2. Snap latch 66 engages ribbon cassette 1 and releasable retains it within cartridge 2.

Spent cassette 1, with depleted ribbon 3, and cartridge 2 are removed from the printing device. Cassette 1 is removed from cartridge 2 by releasing snap latch 66. A fresh cassette 1 is inserted into cartridge 2, and secured into place by fitting it around positioning posts 26 and snap latch 66. Protruding legs 4*a* and 4*b* fit into support legs 14*a* and 14*b*, respectively.

In operation, take-up drive 58 is caused to rotatably move by the print device, not illustrated and in a manner known in the an, thereby causing take-up core 60 to also rotatably move. This conveys ribbon 3 from feed spool 61*a*, around guide pin 63, through exit guide path 174 in protruding arm 4*a*, and out of cassette 1 and cartridge 2 through exit opening 54. While ribbon 3 is outside of cassette 1 and cartridge 2, a print mechanism, not illustrated, engages the ribbon 3. Ribbon 3 continues to be conveyed into entry opening 173 and along entry guide path 175 located in protruding leg 4*b*. Ribbon 3 then threads around guide pin 63 as it reenters storage chamber 5 and is gathered onto take-up spool 62*a*.

A braking mechanism, by way of blocking disc 64 and blocking plate 65, regulates ribbon 3 unwinding from feed spool 61*a*. As blocking disc 64 rotates as a result of ribbon 3 being pulled from it, blocking plate 65 engages the teeth of blocking disc 64 and ratchets its movement incrementally. This prevents ribbon 3 from unravelling from feed spool 61*a*. Such breaking mechanism is known in the art.

FIFTH EMBODIMENT

Referring in detail to FIGS. 5-A through 5-E, there is illustrated another embodiment of ribbon cassette 1 within reloadable cartridge 2 according to this invention.

In this embodiment, five primary differences from FIGS. 4-A through 4-G are illustrated. The first difference is that feed spool 61*a* has mounted above it a ribbon tensioning element 69 for tensioning of ribbon 3. The second difference is that take-up spool 62*a* is rotatably moved by a drive roller 71. The third difference is take-up spool 62*a* is rotatably mounted upon a swing arm 72 which pivots. Swing arm 72, made of injection molded plastic, fits within a depression 78 in the cartridge base 176 on the inside of cartridge 2. The fourth difference is that ribbon cassette 1 has a guide slot 79 for the movement of a take-up pin 68. And, the fifth difference is that no blocking disc 64 and blocking plate 65 are utilized.

In the fast difference, as shown in FIG. 5-A, ribbon 3 winds around the end of a ribbon tensioning element 69 before it passes into exit guide path 174 located within protruding leg 4*a*. Ribbon tensioning element 69, contained within ribbon cassette 1, is positioned above feed spool 61*a*. Tensioning element 69 is prevented from rotating in place by a positioning bump 70, which is embossed in covering 181, and it is designed to be discarded along with ribbon cassette 1 upon the depletion of ribbon 3. Tensioning element 69 is typically constructed of a wire in a manner known in the art. Feed spool 61*a* is mounted upon a feed pin 67.

In the second difference, as shown in FIGS. 5-A and 5-B, take-up spool 62*a*, or a full take-up spool 62*b* with a supply of ribbon 3 contained on it, is rotatably driven by a drive roller 71. The drive roller 71 rotates and causes either take-up spool 62*a* or full take-up spool 62*b* to rotate in a manner known in the art.

In the third difference, as shown in FIG. 5-A, take-up spool 62*a* is rotatably mounted, in a manner known in the art, upon swing arm 72. Swing arm 72 is tensionally mounted, in a manner known in the art, upon an axis 74 by a pivot 73 and an assembly spring 75. Assembly spring 75 is installed around pivot 73 and restrained in place by a spring stop 76 and an arm spring stop 77.

As shown in FIG. 5-B, swing arm 72 is manually rotated away from drive roller 71 and a hook 81 is moved through an arm opening 80 until hook 81 engages a catch 82. As swing arm 72 is rotated away from drive roller 71, a full take-up spool 62*b* and take-up pin 68 become non-tensioned.

And the fourth difference is that while full take-up spool 62*b* and take-up pin 68 are non-tensioned, guide slot 79 allows movement of the full take-up spool 62*b* and take-up pin 68 allowing the cassette 1 to be removed from the cartridge 2.

Spent cassette 1, with depleted ribbon 3, and the cartridge 2 are removed from the printing device in a similar manner as described in FIGS. 4-A through 4-G. Swing arm 72 is positioned as described in a previous paragraph. A fresh cassette 1 is inserted into cartridge 2 in a manner similar, accounting for design differences, to that illustrated in FIGS. 4-A through 4-G. Swing arm 72 is then moved back to operational position by releasing hook 81 from catch 82 thereby allowing swing arm 72 to move towards drive roller 71 causing take-up spool 62*a* to engage drive roller 71. Cassette 1 and the cartridge 2 are reinserted into the printing device.

In operation, drive roller 71 is caused to rotatably move by a print device, not illustrated and in a manner known in the art, thereby causing take-up spool 62*a* to also rotate. This conveys ribbon 3 from feed spool 61*a*, around ribbon tensioning element 69, through exit guide path 174 in protruding arm 4*a*, and out of the cassette 1 and the cartridge 2 through exit opening 54. While ribbon 3 is outside of cassette 1 and cartridge 2, the printing mechanism, not shown in these illustrations, engages the ribbon 3 in printing. Ribbon 3 is then conveyed back into cassette 1 through entry opening 173, along entry guide path 175 located in protruding leg 4*b*, around guide pin 63, and gathered onto take-up spool 62*a*. Assembly spring 75, mounted on swing arm 72, keeps take-up spool 62*a*, mounted upon take-up pin 68, tensionally against drive roller 71.

SIXTH EMBODIMENT

Referring in detail to FIGS. 6-A through 6-C, there is illustrated another embodiment of cassette 1 within cartridge 2 according to this invention. FIGS. 6-A through 6-C are similar in construction and operation as the embodiment shown in FIGS. 4-A through 4-F. The primary difference is the rotary transmission method which comprises a drive band 90.

FIG. 6-A illustrates cassette 1 within cartridge 2. Take-up spool 62*a* is rotatably driven by a drive band 90, in a manner known in the art, which is connected to drive 86. Drive band 90 is maintained in place in both drive 86 and second drive 87, associated with take-up spool 62*a*, by a groove 91. Drive 86 is connected to a holder 88 which is secured to the base 176 of cartridge 2 by a holder axis 89. Drive 86 can be partially pivoted to either side by lifting drive 86 along with holder 88 while holder 88 remains pivotally affixed to the base 176. Holder 88 may be made of either an injection molded plastic or a metal.

FIG. 6-B illustrates cassette 1 with feed spool 61*a*, located in storage chamber 5 and containing ribbon 3. Ribbon 3 threads through exit guide path 174, which is located in protruding leg 4*a*, and out of cassette 1 through exit opening 54. Ribbon 3 reenters cassette 1 through entry opening 173 and threads along entry guide path 175 located in protruding leg 4*b*. Ribbon 3 then reenters storage chamber 5 and is gathered onto take-up spool 62*a*.

As shown in FIG. 6-C, both feed spool 61*a* and take-up spool 62*a* contain an embossed channel 85*b*. An embossed notch 85*a*, made in the covering 181 of cassette 1, is positioned in embossed channel 85*b* to keep feed spool 61 a and take-up spool 62*a* in a fixed position, relative to and inside cassette 1. A second drive 87 is located above take-up spool 62*a*, both of which form an integral unit in the cassette 1 and mount over a roller pin 92. Roller pin 92 is affixed to the cartridge base 176. Drive opening 83 is in the lower portion of protruding leg 4*b* to allow contact of ribbon 3 with a drive 86, as shown in FIGS. 6-A and 6-C.

Spent cassette 1, with depleted ribbon 3, and cartridge 2 are removed from the printing device, which is not illustrated. Drive band 90 is removed from groove 91 of both drive 86 and second drive 87. Drive 86 is pivoted away, represented by dash/double-dot lines on FIG. 6-A, from drive opening 83 thus unlatching cassette 1 within cartridge 2. The spent ribbon cassette 1 is removed and a fresh ribbon cassette 1 is inserted into the cartridge 2. Drive 86 is then pivoted towards and into drive opening 83, and against ribbon 3. Drive band 90 is then reattached to both drive 86 and second drive 87 by placing of band 90 into grooves 91. Fresh cassette 1 and cartridge 2 are then reinserted into the printing device. Drive 86, when in place against 3, also serves as a retaining mechanism for cassette 1 within cartridge 2.

In operation, drive 86 is caused to rotatably move by a print device, in a manner known in the art, thereby causing drive band to transfer rotatable energy to second drive 87. This causes take-up spool 62*a* to rotatably move thereby conveying ribbon 3 from feed spool 61*a* in storage chamber 5, through exit guide path 174, located in protruding arm 4*a*, and out of cassette 1 through exit opening 54. Ribbon 3 is then engaged with a printing mechanism which is not shown in these illustrations. Ribbon 3 is further conveyed and reenters cassette 1 through entry opening 173 and along entry guide path 175 which is located in protruding arm 4*b*. As ribbon 3 passes along entry guide path 175, it is assisted in its conveyance by its tensional contact with rotating drive 86 through drive opening 83. Ribbon 3 then reenters storage chamber 5 and is then gathered upon take-up spool 62*a*. A depleted feed spool 61*b*, as illustrated in FIG. 6-A and represented by a dash/double-dot line, shows the revised circumference of feed spool 61*a* after ribbon 3 has been removed from it. Conversely, a full take-up spool 62*b* shows the circumference of take-up spool 62*a*, and represented by a dash-/double-dot line, after ribbon 3 has been added to it.

SEVENTH EMBODIMENT

Referring in detail to FIGS. 7-A through 7-F, there is illustrated another embodiment of ribbon cassette 1 within reloadable cartridge 2 according to this invention.

FIG. 7-A illustrates the cassette 1 within the cartridge 2. FIG. 7-C illustrates cassette 1 without ribbon 3 threaded through it. The purpose of illustrating cassette 1 without ribbon 3 is to better show the details of cassette 1.

FIG. 7-B illustrates cassette 1 with feed spool 61*a* containing ribbon 3, and ribbon 3 threading around a tension guide 96. Ribbon 3 then threads through exit guide path 174, located in protruding arm 4*a*, and out exit opening 54. Ribbon 3 then reenters cassette 1 through entry opening 173 and threads along entry guide path 175 which is located in protruding arm 4*b*. Ribbon 3 then threads around a guide 95, reenters storage chamber 5, and is gathered onto take-up spool 62*a*. Both tension guide 96 and guide 95 are constructed out of the same material as, and molded or formed at the same time as, the structure of cassette 1. The bottom 182 of tension guide 96 is not affixed to cassette base 179. Tension guide 96 is flexible from the guide hinge 183 portion. Guide hinge 183 is affixed to the cassette base 179. Both feed spool 61*a* and take-up spool 62*a* are joined to a connector 93 which purpose is to keep feed spool 61*a* and take-up spool 62*a* at fixed, but movable, distances from each other. Connector 93 is typically made of either plastic or metal. Connector 93 is held in place by a retainer 98 on both feed spool 61*a* and take-up spool 62*a*. Spool grooves 84 allows for controlled movement within ribbon cassette of both feed spool 61*a* and take-up spool 62*a*.

FIG. 7-D illustrates the cartridge 2 without the insertion of cassette 1. An arm assembly 97, typically made of injection molded plastic, is mounted within a depression 78 of the cartridge base 176 on the inside of cartridge 2. Ann assembly 97 contains feed pin 67 for the mounting of feed spool 61*a*. Arm assembly 97 also contains take-up pin 68 for the mounting of take-up spool 62*a*, and it is partially rotatably movable about axis 74. Drive roller 71 is in a rotatable, but fixed, position. A spool spring 100, typically made of a coil wire spring in a manner known in the art, is mounted around a spring axis 102 with a spool spring end 101 being positioned between spring stops 76. Positioning posts 26 align, and snap latch 66 secures, cassette 1 within cartridge 2.

Spent cassette 1, with depleted ribbon 3, and cartridge 2 are removed from the printing device which is not illustrated. A spool spring arm 99 is removed from take-up pin 68. Take-up spool 62*a* is moved along spool groove 84 to disengage it from drive roller 71. Snap latch 66 is pressed allowing release of cassette 1 from cartridge 2. The spent cassette 1 is removed and a fresh cassette 1 is inserted into the cartridge 2 by fitting a core opening 94, one such opening 94 each on feed spool 61*a* and take-up spool 62*a*, around both feed pin 67 and take-up pin 68, both located on arm assembly 97. Spool spring arm 99 is reinstalled around take-up pin 68. The tension of spring arm 99 against pin 68 moves take-up spool 62*a* along spool groove 84 and into engagement with drive roller 71. Fresh cassette 1 and cartridge 2 are then reinserted into the printing device.

In operation, drive roller 71 is caused to rotatably move by the print device in a manner known in the art. As take-up spool 62*a* tensionally rests against drive roller 71 the rotatable movement of drive roller 71 causes take-up spool 62*a* to also rotate. The rotation of take-up spool 62*a* conveys ribbon 3 from feed spool 61*a*, around tension guide 96, and through exit guide path 174 located in protruding arm 4*a*. Ribbon 3 then exits cassette 1 through exit opening 54 and is engaged with a printing mechanism. The printing mechanism, not shown in these illustrations, engages ribbon 3 in a manner known in the art. Ribbon 3 then reenters cassette 1 through entry opening 173 and into entry guide path 175 which is located in protruding arm 4*b*. Ribbon 3 passes around guide 95, back into storage chamber 5, and is gathered onto take-up spool 62*a*. As take-up spool 62*a* grows in circumference with an increase in volume of ribbon 3, it moves along spool groove 84 maintaining constant tensional contact with drive roller 71. This movement also causes a corresponding movement along spool groove 84 of the feed spool 61*a* as it decreases in size due to the depletion of ribbon 3.

EIGHTH EMBODIMENT

Referring in detail to FIGS. 8-A through 8-H, them is illustrated another embodiment of cassette 1 within cartridge 2 according to this invention.

FIGS. 8-A through 8-H are similar in many respects to FIGS. 4-A through 4-G. There are three basic differences, however. First, a movable take-up spool 62*a* tensionally rests against the drive roller 71 and is tensionally positioned by a take-up spool spring 103. Spool spring 103 is located within cassette 1. Second, cassette 1 contains a spacing method for the spacing of take-up spool 62*a* away of drive roller 71. Third, Protruding arms 4*a* and 4*b* on cassette 1 do not fit into support legs 14*a* and 14*b* in the cartridge 2 as they do in the other embodiments. As such, the differences between FIGS. 8-A through 8-H and FIGS. 4-A through 4-G will be emphasized in this embodiment description.

FIG. 8-B illustrates cassette 1. Ribbon 3 threads off feed spool 61*a*, located in storage chamber 5, around guide 95, and through exit guide path 174 which is located in protruding arm 4*a*. Ribbon 3 then exits cassette 1 through exit opening 54. Ribbon 3 then reenters cassette 1 through entry opening 173 and threads along entry guide path 175 which is located in protruding arm 4*b*. Ribbon 3 then threads around guide pin 63, back into storage chamber 5, and is then gathered onto take-up spool 62*a*.

The first difference, as shown in FIG. 8-A, shows take-up spool 62*a* tensionally positioned against drive roller 71 by a take-up spool spring 103 which pivots partially around spring axis 102. Spool spring 103 is typically constructed of a wire spring in a manner known in the art.

In the second difference, slide spacer 104 maneuvers within a spacer groove 105 and is designed to position take-up spool 62*a* either away from or into drive opening 83. Slide spacer 104 is typically constructed of injection molded plastic. Take-up spool spring 103 is located within, not external, to cassette 1 in this embodiment.

Take-up spool 62*a*, when spacer 104 is positioned away from it, is in an engaged position 107 against drive roller 71. This engaged position 107 allows the take-up spool 62*a* to be rotatably moved by drive roller 71 as a result of rotatable movement by drive roller 71. The rotatable movement of drive roller 71 by a printing device is known in the art.

FIGS. 8-C, 8-D, and 8-H illustrate the positioning of slide spacer 104 in detail. In FIGS. 8-C and 8-H, slide spacer 104 is positioned away from take-up spool 62*a* and thereby allows take-up spool 62*a* engagement with drive roller 71 through drive opening 83. FIG. 8-D shows slide spacer 104 positioned against take-up spool 62*a* and thereby prevents engagement of take-up spool 62*a* with drive roller 71 through drive opening 83. In a non-engaged position 106, cassette 1 can be removed from cartridge 2. As seen, slide spacer 104 can be positioned against both the spent volume of ribbon 3 on take-up spool 62*a* or the full volume of ribbon 3 on take-up spool 62*b* represented by a dash/double-dot line.

FIGS. 8-E through 8-G illustrate another embodiment whereby slide spacer 104 has been replaced with a twist spacer 108 which pivots partially about a spacer axis 109. In FIGS. 8-E and 8-F, take-up spools 62*a* and also 62*b*, represented by a dash/double-dot line, are in the engaged position 107 against drive roller 71 through drive opening 83. In FIG. 8-G, twist spacer 108 has been partially pivoted to the non-engaged position 106, thereby not allowing engagement of take-up spools 62*a* and also 62*b*, represented by a dash/double-dot line, with drive roller 71 through drive opening 83.

The third difference in this embodiment is that there are no support legs 14*a* and 14*b* in cartridge 2 for the support of protruding legs 4*a* and 4*b* in cassette 1. Instead, protruding legs 4*a* and 4*b* rest in leg supports 110 in the cartridge 2.

Spent cassette 1, with depleted ribbon 3, and cartridge 2 are removed from the printing device. Either slide spacer 104 or twist spacer 108 is positioned so that take-up spool 62*a* or 62*b* is in the non-engaged position 106 with drive roller 71 through drive opening 83. Snap latch 66 is pressed allowing release of cassette 1 from cartridge 2. The spent cassette 1 is removed and a fresh cassette 1 is inserted into the cartridge 2. In detail, protruding legs 4*a* and 4*b* position each into a leg support 110, ribbon 3 is inserted into a tip 184 of a hinged arm 165, ribbon cassette 1 positions around positioning posts 26, feed core 59 fits around gear drive 57, and snap latch 66 encloses about a section of ribbon cassette 1. Slide spacer 104 or twist spacer 108 is then positioned to allow take-up spool 62*a* to be in the engaged position 107 with drive roller 71 through drive opening 83.

In operation, drive roller 71 is caused to rotatably move by the print device, not illustrated, in a manner known in the art. This causes take-up spool 62*a* to rotatably move in a manner which conveys ribbon 3 from feed spool 61*a*, around guide 95, and through exit guide path 174 which is located in protruding arm 4*a*. Ribbon 3 exits cassette 1 through exit opening 54 where it is engaged with a printing mechanism, not shown in these illustrations. Ribbon 3 then reenters cassette 1 through entry opening 173 and is conveyed through entry guide path 175 which is located in protruding arm 4*b*. Ribbon 3 passes around guide pin 63, back into storage chamber 5, and is gathered onto take-up spool 62*a*. A depleted feed spool 61*b*, as illustrated in FIG. 8-A and represented by a dash/double-dot line, shows the revised circumference of feed spool 61*a* after ribbon 3 has been removed from it. Conversely, a full take-up spool 62*b*, represented by a dash/double-dot line, shows the circumference of take-up spool 62*a* after ribbon 3 has been added to it. In addition, the corresponding position of spring 103 is also represented by a dash/double-dot line.

NINTH EMBODIMENT

Referring in detail to FIGS. 9-A through 9-E, there is illustrated another embodiment of cassette 1 within cartridge 2 according to this invention.

FIGS. 9-A through 9-E are similar to FIGS. 8-A through 8-H. The primary difference is the method of allowing engagement of take-up spool 62*a* with drive roller 71, and feed spool 61*a* being tensionally positioned and maneuvered by a feed spool spring 111. As such, the primary difference will be described.

FIG. 9-A illustrates cassette 1 within the cartridge 2. Feed spool 61*a* is tensionally positioned and maneuvered by a feed spool spring 111, typically constructed of a wire spring and known in the art, about a spring axis 102. Feed spool 61*a* rests against the inside of cassette wall 180, or an inside wall 178, of cassette 1. Feed spool spring 111 and spring axis 102 are installed in cassette 1, and both are a subpart of cassette 1. Ribbon 3 threads from feed spool 61*a*, located in storage chamber 5, around guide pin 63, and through exit guide path 174 which is located in protruding arm 4*a*. Ribbon 3 then exits cassette 1 through exit opening 54. Ribbon 3 then reenters cassette 1 through entry opening 173 and threads along entry guide path 175 which is located in protruding arm 4*b*. Ribbon 3 is then positioned by guide pin 63, and is gathered onto take-up spool 62*a* which is located in the storage chamber 5. Take-up spool 62*a* is rotatably moved by drive roller 71 with blocking plate 65 engaging a plurality of teeth arranged on the outer edge of drive roller 71. Such blocking plate 65 is known in the art.

As illustrated in FIGS. 9-A through 9-E, a slide 112 is positioned in a channel 115 and against the inside wall 178 of cassette 1 and a channel guide 116. Slide 112 is designed to permit or prevent engagement of take-up spool 62*a* with drive roller 71 through drive opening 83. Slide 112 is typically constructed of injection molded plastic. Slide 112 may be positioned, by way of a slide tab 113, inside channel 115 to allow take-up spool 62*a* to partially protrude through a slide opening 114 and drive opening 83 and thereby engage drive roller 71. Slide 112 may be positioned so that slide opening 114 is not aligned with take-up spool 62*a*, thereby causing non-engagement of take-up spool 62*a* with drive roller 71 through opening 83 and causing take-up spool 62*a* to rest on the inside of slide 112.

Spent cassette 1, with depleted ribbon 3, and cartridge 2 are removed from the printing device. Slide 112 is positioned so that take-up spool 62*a* does not partially protrude through slide opening 114 and opening 83 thereby disengaging take-up spool 62*a* from drive roller 71. Snap latch 66 is pressed allowing release of cassette 1 from cartridge 2. The spent cassette 1 is removed and a fresh cassette 1 is inserted into the reloadable cartridge 2. In detail, protruding arms 4*a* and 4*b* position into support legs 14*a* and 14*b*, respectively, cassette 1 positions around positioning posts 26, and snap latches 66 enclose about sections of cassette 1. Slide 112 is moved, by way of slide tab 113, so that slide opening 114 is aligned with opening 83 and take-up spool 62*a*. Take-up spool 62*a* is now allowed to partially protrudes through slide opening 114 and opening 83. This allows take-up spool 62*a* to engage, and thus be able to be rotatably moved, by drive roller 71. Take-up spool spring 103, partially rotatable about spring axis 102, exerts tension upon take-up spool 62*a* to keep it in a tensioned position whereby it will always rest against either slide 112 or drive roller 71. Ribbon cassette 1 and reloadable cartridge 2 are then reinserted into the printing device for operation.

In operation, drive roller 71 is caused to rotatably move by a print device in a manner known in the art. This causes take-up spool 62*a* to rotatably move in a manner which conveys ribbon 3 from feed spool 61*a*, around guide pin 63, and through exit guide path located in protruding arm 4*a*. Ribbon 3 then exits cassette 1 through exit opening 54 and is engaged with a printing mechanism which is not shown in these illustrations and is known in the art. Ribbon 3 then is conveyed back into cassette 1 through entry opening 173 and along entry guide path 175 which is located in protruding arm 4*b*. Ribbon 3 is then further conveyed around guide pin 63, back into storage chamber 5, and gathered onto take-up spool 62*a*.

Feed spool 61*a* diminishes in circumference to feed spool 61*b*, and take-up spool 62*a* increases in circumference to take-up spool 62*b*, as ribbon 3 is transferred from feed spool 61*a* to take-up spool 62*a*. As shown in FIG. 9-A, a depleted feed spool 61*b* and full take-up spool 62*b* are both represented by dash/double-dot lines. In addition, the correspondingly changed positions of take-up spool spring 103 and feed spool spring 111 are represented by dash/double-dot lines.

TENTH EMBODIMENT

Referring in detail to FIGS. 10-A through 10-F, them is illustrated another embodiment of this invention which illustrate various components of a disposable ribbon cassette within a reloadable cartridge for insertion into computer printers, typewriters, office machines, stenographic printers, or other printing devices utilizing an endless loop ribbon configuration or a ribbon with an end but utilizing a reloadable cartridge.

FIGS. 10-A through 10-F are similar in many respects to FIGS. 1-A through 1-H. The primary differences are the addition of a retaining latch 167, a tension flap 117, an idler gear assembly 129, a drive gear assembly 130, and a shield 120. Also, the embodiment detailed in FIGS. 10-A through 10-F does not have a cover 19; see FIGS. 1-A through 1-H. As such, only the primary differences between FIGS. 10-A through 10-F and FIGS. 1-A through 1-H will be described.

FIG. 10-B details cassette 1 without ribbon 3 threaded through it. The purpose of illustrating cassette 1 without ribbon 3 is to better show the details of cassette 1.

FIG. 10-A also details cassette 1. As shown, ribbon 3 is contained within storage chamber 5 in a series of loops as is known in the art. Ribbon 3 threads through opening 6 and twists over a mobius ridge 7 which purpose is to place a mobius twist in the ribbon. Such mobius twist is known in the art as a method of extending the printing life of ribbon 3. Ribbon 3 then enters exit guide path 174 located in protruding leg 4*a*. While in exit guide path 174, ribbon 3 is tensioned by a tension flap 117. Tension flap 117 is formed by a section of protruding leg 4*a* of cassette 1 being displaced inwards in protruding leg 4*a* by a post 118 which is located in exit support leg 14*a*. The purpose of tension flap 117 is to produce a tension upon ribbon 3. Ribbon 3 then exits cassette 1 through exit opening 54. Ribbon 3 then reenters cassette 1 through entry opening 173 and is threaded along entry guide path 175 located in protruding arm 4*b*. Ribbon 3 then winds around a path 119, exits a path opening 124, and reenters storage area 5 through storage opening 28.

FIG. 10-A also details a retaining latch 167, typically constructed of injection molded plastic, which is partially pivotable about a retainer axis 168. Retaining latch 167 partially pivots to secure cassette 1 within cartridge 2. Cassette 1 contains a bump 139 to catch and maintain retaining latch 167.

Tension flap 117, as shown in FIGS. 10-A, 10-A', and 10-B, is created with a section of protruding leg 4*a* and is made at the time of manufacture of ribbon cassette 1. As shown in FIGS. 10-A and 10-A', upon the insertion of ribbon cassette 1 into reloadable cartridge 2, an unpositioned tension flap 117 comes into contact with positioning post 26 and post 118. Both positioning post 26 and post 118 are within support leg 14*a* of reloadable cartridge 2. Protruding leg 4*a* is supported on one side by positioning post 26. On the other side of protruding leg 4*a*, tension flap 117 is pinched inwards, or positioned, into protruding leg 4*a* by post 118. The inward pinching of tension flap 117 causes it to tensionally rest upon ribbon 3 thereby creating a tension upon ribbon 3. The tension exerted upon ribbon 3 is normally created by tensioning spring 13 as seen in FIG. 1-A.

An idler gear assembly 129 is comprised of idler gear 10 being encased within a gear housing 126, typically constructed of injection molded plastic, and partially pivotable about a gear assembly axis 127. Idler gear assembly 129 is under tension from a gear assembly spring 125, which is secured in place by a spring retainer 128. Gear assembly spring 125 is typically constructed of a wire spring. Idler gear assembly 129 is restrained in pivotable movement in part by a block 169.

Drive gear assembly 130 is comprised of drive gear 9 being encased within a drive gear housing 166, typically constructed of injection molded plastic, and partially pivotable about a drive gear assembly axis 131. Drive gear assembly 130 is under tension of a drive gear assembly spring 132 which direction of tension is away from idler gear assembly 129. Drive gear assembly spring 132 is typically constructed of a wire spring.

Drive gear assembly 130 is positioned tensionally against idler gear assembly 129 by the pivoting of a latch assembly 134. Latch assembly 134, typically constructed of injection molded plastic, is partially pivotable about a latch axis 137 and secured to latch axis 137 by a latch retainer 138. Upon the positioning of latch assembly 134, a latch arm 135 fits into a notch 133 of drive gear assembly 130, and a latch handle 136 rests between bumps 139 located on the cassette covering 181 of a cassette section 140. Upon the release of the positioning of, by partially pivoting, latch assembly 134, latch arm 135 is pivoted out of notch 133 and latch handle 136 is pivoted out from the secure of bumps 139. This action causes drive gear assembly spring 132 to tension and position drive gear assembly 130 away from idler gear assembly 129.

For the remainder of this embodiment description, ribbon 3 is more narrowly defined as an ink ribbon. In addition, ribbon 3 is capable of accepting a new supply of ink from an ink roller reinking method. Ribbon 3 in the rest of the Specification is not defined so narrowly.

An ink roller, not shown in these illustrations, is a device known in the an to reapply ink, by way of a transfer roller 141, to a ribbon 3 as the supply of ink of ribbon 3 is depleted in the regular course of printer use. The purpose of an ink roller is to extend the life of ribbon 3 by reapplying ink to the ribbon 3. An ink roller, as known in the art, is contained within cartridge 2.

A transfer roller assembly 171 is comprised of transfer roller 141 which is pivotally mounted upon a roller post 143 and retained in place by a roller retainer 142. Transfer roller 141 is comprised of various materials which are known in the art.

As shown in FIG. 10-D, a shield 120, typically constructed of a flexible plastic and in a manner as to fit into a slot 122, covers a shield opening 123. The purpose of the shield 120 is to position ribbon 3 at a place in path 119 so to allow the easy insertion of cassette 1 into cartridge 2 with no space interference from the transfer roller assembly 171, or from any other reinking assembly which is not illustrated here.

In this embodiment, shield 120 is removed, by way of pulling on a shield tab 121, after insertion of cassette 1 into cartridge 2. Once the shield 120 is removed, ribbon 3 comes into contact with transfer roller assembly 171. FIG. 10-B shows cassette 1 without shield 120 so that the details of path 119, slots 122, and shield opening 123 can be better shown.

Another purpose of shield 120 is to retain ribbon 3 in path 119 in the event ribbon cassette 1 is inserted into a reloadable cartridge 2 which does not contain a reinking assembly. In this instance, shield 120 is not removed after cassette 1 insertion into cartridge 2.

Spent cassette 1, with depleted ribbon 3, and cartridge 2 are removed from the printing device. Retaining latch 167 is partially pivoted to cause non-contact with ribbon cassette 1. Latch assembly 134 is partially pivoted, in the direction of the arrow on FIG. 10-A, to cause both non-contact with ribbon cassette 1 and a release of tension of drive gear assembly 130 against idler gear assembly 129.

The spent cassette 1 is removed and a fresh cassette 1 is inserted into the cartridge 2 with post 118 positioning tension flap 117. Retaining latch 167 is partially pivoted to restrain ribbon cassette 1, and latch assembly 134 is also partially pivoted to advance drive gear assembly 130 to tension ribbon 3 between it and idler gear assembly 129. If cassette 1 has been inserted into a cartridge 2 which has a reinking device, then shield 120 is removed. Cassette 1 and cartridge 2 are reinserted into the printing device.

In operation, drive gear 9 is caused to rotatably move by the print device in a manner known in the art. The rotatable tension of ribbon 3 between drive gear 9 and idler gear 10 causes ribbon 3 to be pulled and conveyed from storage chamber 5 and through opening 6. Ribbon 3 is caused to have a mobius twist as it is drawn over mobius ridge 7. Ribbon 3 is then conveyed into exit guide path 174 where it is tensioned by contact with tension flap 117. Ribbon 3 is then conveyed out of cassette 1 through exit opening 54. Ribbon 3 is then engaged with a printing mechanism which is not shown in these illustrations and in a manner known in the art. After contact with the printing mechanism, ribbon 3 is conveyed back into ribbon cassette 1 through entry opening 173 and along entry guide path 175 which is located in protruding leg 4*b*. Ribbon 3 is conveyed along the length of entry guide path 175 until it makes contact with transfer roller 141 along path 119. Ribbon 3, upon its contact with transfer roller 141, causes transfer roller 141 to rotate thereby causing a transfer of ink from transfer roller 141 to ribbon 3. A reinked ribbon 3 then exits path opening 124, is engaged and advanced by drive gear 9 and idler gear 10, and reenters storage chamber 5 through storage opening 28.

SUMMARY, RAMIFICATIONS, AND SCOPE

Accordingly, the reader will see that the disposable ribbon cassette within a reloadable cartridge of this invention provides a two-part system substitution for the standard reloadable ribbon cartridge known and commonly used in the art. The two-part system of a disposable ribbon cassette within a reloadable cartridge of this invention is a non-expensive method of achieving delivery of a ribbon to the print mechanism of a printing device.

The reloadable cartridge is capable of being inserted to and removed from, not permanently mounted within nor affixed to, a printing device. The printing device requires no modification in order to utilize this invention. The reloadable cartridge in many embodiments comprises the drive and tensioning elements necessary to convey the ribbon within the cassette and to a printing mechanism. The cassette contains, in addition to the ribbon, sufficient guide paths and other structure and elements to eliminate the necessity of hand threading the ribbon within the reloadable cartridge. The standard reloadable ribbon cartridge currently used with a corresponding printing device may be easily substituted with an embodiment of this invention of a two-part reloadable ribbon cartridge system.

This invention of a two-part reloadable ribbon cartridge system provides an economical, efficient, and clean method of separating the ribbon, a spendable element, of a reloadable ribbon cartridge from those elements which can be continued to be utilized after the ribbon has been spent.

Additionally, various embodiments of this invention, can be applied to spool-type ribbon cartridges, endless loop-type ribbon cartridges, and other ribbon arrangements of ribbons having an end but utilizing a reloadable cartridge configuration. Many of these embodiments are illustrated and described in this Specification.

Furthermore, the two-part system of a disposable ribbon cassette within a reloadable cartridge of this invention provides a device which:

(a) in numerous and varied embodiments and adaptations of the invention, both shown and not shown, is easily retrofittable to the many types and numbers of existing computer printers, typewriters, office machines, stenographic printers, and other printing devices;

(b) does not require the hand threading of the ribbon around the ribbon guide devices, drive devices, and reinking devices of the numerous and varied embodiments and adaptations of the invention, both shown and not shown;

(c) does not require a permanent adapter be constructed and affixed or mounted to existing computer printers, typewriters, office machines, stenographic printers, and other printing devices in order to utilize the benefit of this invention;

(d) allows the components comprising the bulk of the reloadable cartridge, usually including items such as the body, gears, springs, and tensioning devices, to be used over again after the depletion of the ribbon, thereby providing a significant savings to the reloadable cartridge user.

Although the description previously and above contains many specificities, these should not be construed as limiting the scope of this invention but as merely providing illustrations of some of the presently preferred embodiments of this invention. For example, the addition, deletion, location, arrangement, containment, shape, geometry, size, material, configuration, type, and/or fit of the various;

(a) drive and idler gears, wheels, bands, rotary transmission methods, and rotatable driving methods,
(b) ribbon tensioning devices and methods,
(c) springs,
(d) ribbon cassettes,
(e) positioning methods,
(f) protruding legs and support legs,
(g) ribbon, gearing, and other openings,
(h) covers,
(i) reloadable cartridges,
(j) pull tabs,
(k) feed and take-up spools,
(l) feed and take-up spool cores,
(m) drive, positioning, and mounting pins,
(n) ribbon types and constructions,
(o) ink types,
(p) pivotable armatures and devices,
(q) spacing methods,
(r) hinges, and
(s) other elements and details;

used throughout this invention, in embodiments both shown and not shown, may be modified, adjusted, and/or combined to suit the embodiment needs and requirements of various print devices and tasks.

Thus the scope of this invention should be determined by the appended claims and their legal equivalents, rather than by the examples given.

I claim:

1. A two-part ribbon cartridge and cassette system for use on a printing device, comprising in combination:

a reloadable cartridge independent of said printing device but releasably carried by the printing device;

ribbon driving means carried by the cartridge;

a disposable cassette having a ribbon therein releasably connected to said reloadable cartridge, said cassette being removable from said reloadable cartridge without requiring removal of the cartridge from the printing device;

a storage chamber in the cassette for storing said ribbon;

an exit opening and an entry opening for the storage chamber;

a ribbon entry guide path positioned adjacent the entry opening of the storage chamber;

a ribbon exit guide path extends from the exit opening of the storage chamber;

said ribbon extending From the storage chamber via the exit opening and the exit guide path into the storage chamber via the entry guide path and the entry opening as an endless loop for passing through the printing device;

said ribbon driving means comprising at least a pair of rotary means carried by the cartridge but engaging the ribbon between them in the cassette;

said cassette having an opening to permit ribbon driving;

at least a portion of the ribbon driving means penetrating the cassette via said opening when the cassette is connected to the cartridge;

biasing means effective at the ribbon driving means to cause the ribbon driving means to grip the ribbon for driving ribbon contacting engagement therewith;

means permitting release of the biasing means to allow the ribbon to be inserted into the ribbon driving means for driving and to be removed therefrom for cassette replacement; and said cassette being removable from the ribbon contacting engagement driving means for disposal.

2. The cartridge system of claim 1, wherein:

said ribbon driving means is separable to receive the ribbon for propelling it out of and into the storage chamber.

3. A ribbon cartridge system for use on a printing device, comprising:

a reloadable cartridge;

a cassette having a ribbon therein to fit said reloadable cartridge, said cassette being removable from said reloadable cartridge even while the cartridge remains installed in the printing device, said cassette having a body member;

said cartridge having an integral back member;

a storage chamber in the cassette body member for said ribbon;

a ribbon take-up spool and a ribbon supply spool storing contained in said storage chamber;

ribbon tensioning means carried by the integral back member having a fixed perimeter;

an exit opening and an entry opening disposed on the storage chamber;

a ribbon entry guide path positioned adjacent the entry opening of the storage chamber;

a ribbon exit guide path extends from the exit opening of the storage chamber;

said ribbon extending from the supply spool in the storage chamber via the exit opening and the exit guide path into the storage chamber via the entry guide path and the entry opening and onto the take-up spool;

means carried by the integral back member at a fixed location thereon within the fixed perimeter of the back member for driving the ribbon;

a spool pivot member supported by the integral back member carrying at least one of said spools via an opening in the cassette when the cassette is installed in the cartridge;

tensioning means carried by the spool pivot member for biasing said one spool against the driving means;

an arcuate guide path in the cassette;

follower pin means permitting at least one of the spools to follow said arcuate path along the back member as the spool changes in diameter due to changing ribbon volume;

said spool pivot member permitting at least one of said spools to move away from the driving means for replacement of the cassette;

said spool pivot member, tensioning means, arcuate path, and said follower pin means all disposed within the fixed perimeter of the back member and to enable said cassette to be directly removed from the printing device retained cartridge; and, said exit and entry guide paths being integral with said body member and serving to guide the ribbon through the printing device when the cassette is inserted into the already positioned cartridge, or when the cartridge, including the cassette, is positioned in the printing device.

4. A two-part ribbon cartridge and cassette system for use on a printing device, comprising in combination:

a reloadable cartridge for use in said printing device but being removable therefrom;

a ribbon cassette having a ribbon therein insertable into and removable from the cartridge even when the cartridge is installed in the printing device:

a ribbon storage chamber in said cassette;

said cartridge having an integral back member having a fixed perimeter;

a ribbon driving means carried by the back member for causing the ribbon to exit and enter said storage chamber;

ribbon tensioning means carried by the back member;

said cassette having a body deployable against said back member when the cassette is inserted in the cartridge;

said driving means comprising rotary means carried by the cartridge but engaging the ribbon in the cassette;

said cassette having an opening to permit ribbon driving;

at least a portion of the driving means penetrating the cassette via said opening when said cassette is connected to the cartridge;

biasing means effective with the driving means to cause the driving means to bear against the ribbon for driving ribbon contacting engagement therewith;

means permitting release of the biasing means to allow the ribbon to be inserted for driving and to be removed for cassette replacement;

said cassette being removable from the ribbon contacting engagement driving means for disposal:

entrance means for the ribbon to the storage chamber and exit means for the ribbon from the storage chamber;

said ribbon driving means being carried by the integral back member at a fixed location thereon within the fixed perimeter of the back member for driving the ribbon; and the ribbon driving means, the ribbon tensioning means, and the cassette within the back member fixed perimeter enabling said cassette to be directly removed from the printing device retained cartridge.

5. The cartridge system of claim 4, wherein:

said storage chamber is spooless and the ribbon is contained therein in short loop fashion.

6. The cartridge system of claim 5, wherein:

said driving means is separable to receive the ribbon for propelling it out of and into the storage chamber.

7. The cartridge system of claim 6, wherein:

said driving means comprise at least two rotatable driving elements carried by the cartridge integral back member for gripping the ribbon.

8. The cartridge system of claim 7, further comprising resilient means carried by at least one of the cartridge and for the cassette at least one of biasing and tensioning said ribbon against said ribbon driving means.

9. The cartridge system of claim 4 further comprising at least one spool in the storage chamber for storing the ribbon.

* * * * *